US011008858B2

(12) United States Patent
Lee et al.

(10) Patent No.: US 11,008,858 B2
(45) Date of Patent: May 18, 2021

(54) FLUID PRESSURE PULSE GENERATOR FOR A TELEMETRY TOOL

(71) Applicant: Evolution Engineering Inc., Calgary (CA)

(72) Inventors: Gavin Gaw-Wae Lee, Calgary (CA); Justin C. Logan, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 130 days.

(21) Appl. No.: 16/475,177

(22) PCT Filed: Dec. 7, 2017

(86) PCT No.: PCT/CA2017/051481
§ 371 (c)(1),
(2) Date: Jul. 1, 2019

(87) PCT Pub. No.: WO2018/119511
PCT Pub. Date: Jul. 5, 2018

(65) Prior Publication Data

US 2020/0003050 A1 Jan. 2, 2020

Related U.S. Application Data

(60) Provisional application No. 62/440,048, filed on Dec. 29, 2016.

(51) Int. Cl.
*E21B 47/18* (2012.01)
*E21B 4/02* (2006.01)
*E21B 47/06* (2012.01)

(52) U.S. Cl.
CPC ..... *E21B 47/18* (2013.01); *E21B 4/02* (2013.01); *E21B 47/06* (2013.01)

(58) Field of Classification Search
CPC ..... E21B 47/18; E21B 4/02; E21B 47/06
See application file for complete search history.

(56) References Cited

U.S. PATENT DOCUMENTS 4,785,300 A * 11/1988 Chin ..... E21B 47/18 367/83
4,825,421 A * 4/1989 Jeter ..... G01V 1/137 367/83

(Continued)

FOREIGN PATENT DOCUMENTS

CA 2952659 12/2015
CA 2967494 6/2016

(Continued)

OTHER PUBLICATIONS

International Search Report and Written Opinion in corresponding PCT/CA2017/051481, dated Mar. 13, 2018.

*Primary Examiner* — Amine Benlagsir
(74) *Attorney, Agent, or Firm* — Hovey Williams LLP

(57) ABSTRACT

A fluid pressure pulse generator apparatus for a telemetry tool comprising a stator and a rotor. The stator comprises a stator body and a plurality of radially extending stator projections spaced around the stator body and the spaced stator projections define stator flow channels extending therebetween. The rotor comprises a rotor body and a plurality of radially extending rotor projections spaced around the rotor body. The rotor projections are axially adjacent the stator projections and the rotor is rotatable relative to the stator such that the rotor projections move in and out of fluid communication with the stator flow channels to create fluid pressure pulses in fluid flowing through the stator flow channels. At least one of the rotor projections and at least one of the stator projections has a standard outer diameter. At least one of the rotor projections and/or at least one of the stator projections has a reduced outer diameter.

(Continued)

The reduced outer diameter rotor and/or stator projections provide bypass channels for flow of fluid and allow for generation of a pattern of different fluid pressure pulses.

29 Claims, 16 Drawing Sheets

(56) References Cited

U.S. PATENT DOCUMENTS 4,914,637 A * 4/1990 Goodsman ..... E21B 47/18 367/83
5,586,083 A * 12/1996 Chin ..... E21B 47/18 367/84
5,636,178 A * 6/1997 Ritter ..... E21B 47/20 367/83
5,831,177 A * 11/1998 Waid ..... E21B 43/14 73/861.77
6,219,301 B1 * 4/2001 Moriarty ..... E21B 47/18 367/84
2002/0117306 A1 * 8/2002 Hahn ..... E21B 47/20 166/373
2011/0073374 A1 * 3/2011 Bunney ..... E21B 21/103 175/107
2012/0127829 A1 * 5/2012 Sitka ..... E21B 47/24 367/83
2015/0285067 A1 * 10/2015 Logan ..... E21B 21/08 175/317
2015/0354280 A1 * 12/2015 Downton ..... F03B 13/02 175/107
2016/0245079 A1 * 8/2016 Perry ..... E21B 47/20

FOREIGN PATENT DOCUMENTS

CA 2973007 9/2016
GB 2407598 5/2005

* cited by examiner

FLUID PRESSURE PULSE GENERATOR FOR A TELEMETRY TOOL

RELATED APPLICATIONS

This application is the National Stage entry of International Patent Application No. PCT/CA2017/051481, filed Dec. 7, 2017, which claims the benefit of U.S. Provisional Patent Application No. 62/440,048, filed Dec. 29, 2016, both of which are incorporated by reference herein in their entireties.

FIELD

This disclosure relates generally to a fluid pressure pulse generator for a telemetry tool, such as a mud pulse telemetry measurement-while-drilling ("MWD") tool.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which generally comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole MWD telemetry known as mud pulse telemetry involves creating pressure waves ("pulses") in the drilling mud circulating through the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Pulse frequency is typically governed by pulse generator motor speed changes. The pulse generator motor requires electrical connectivity with the other elements of the MWD probe.

One type of valve mechanism used to create mud pulses is a rotor and stator combination where a rotor is rotated relative to the stator between an opened position where there is no restriction of mud flowing through the valve and no pulse is generated, and a restricted flow position where there is restriction of mud flowing through the valve and a pressure pulse is generated.

SUMMARY

According to a first aspect, there is provided a fluid pressure pulse generator apparatus for a telemetry tool comprising a stator and a rotor. The stator comprises a stator body and a plurality of radially extending stator projections spaced around the stator body, wherein the spaced stator projections define stator flow channels extending therebetween. The rotor comprises a rotor body and a plurality of radially extending rotor projections spaced around the rotor body. The rotor projections are axially adjacent the stator projections and the rotor is rotatable relative to the stator such that the rotor projections move in and out of fluid communication with the stator flow channels to create fluid pressure pulses in fluid flowing through the stator flow channels. Wherein:

(i) at least one of the rotor projections has a standard outer diameter and at least one of the rotor projections has an outer diameter which is reduced compared to the outer diameter of the at least one rotor projection with the standard outer diameter; or (ii) at least one of the stator projections has a standard outer diameter and at least one of the stator projections has an outer diameter which is reduced compared to the outer diameter of the at least one stator projection with the standard outer diameter; or (iii) at least one of the rotor projections has a standard outer diameter and at least one of the rotor projections has an outer diameter which is reduced compared to the outer diameter of the at least one rotor projection with the standard outer diameter, and at least one of the stator projections has a standard outer diameter and at least one of the stator projections has an outer diameter which is reduced compared to the outer diameter of the at least one stator projection with the standard outer diameter.

The rotor projections may have a radial profile comprising an uphole end and downhole end with two opposed side faces and a distal face extending between the uphole end and the downhole end, wherein the uphole end or the downhole end of the rotor projections comprises a rotor radial face. The radial length of the rotor radial face of the at least one rotor projection with the reduced outer diameter may be reduced compared to the radial length of the rotor radial face of the at least one rotor projection with the standard outer diameter. The stator projections may have a radial profile with an uphole end and downhole end with two opposed side faces and a distal face extending between the uphole end and the downhole end, wherein at least one of the uphole end or the downhole end of the stator projections comprises a stator radial face and the stator radial face is axially adjacent and faces the rotor radial face. The radial length of the stator radial face of the at least one stator projection with the reduced outer diameter may be reduced compared to the radial length of the stator radial face of the at least one stator projection with the standard outer diameter.

The apparatus may comprise two or more reduced outer diameter rotor projections and two or more standard outer diameter rotor projections, wherein the reduced outer diameter rotor projections alternate with the standard outer diameter rotor projections.

The apparatus may comprise two or more reduced outer diameter stator projections and two or more standard outer diameter stator projections, wherein the reduced outer diameter stator projections alternate with the standard outer diameter stator projections.

The stator body may have a bore therethrough and at least a portion of the rotor body may be received within the bore. The rotor body may have a bore therethrough and the apparatus may further comprise a rotor cap comprising a cap body and a cap shaft, the cap shaft being received in the bore of the rotor body and configured to releasably couple the rotor body to a driveshaft of the telemetry tool.

The rotor projections may be downhole of the stator projections.

The apparatus may comprise: at least one reduced outer diameter rotor projection and at least one standard outer diameter rotor projection; and at least one reduced outer diameter stator projection and at least one standard outer diameter stator projection. The rotor may be configured to rotate between three different flow positions to generate pressure pulses, the three different flow positions comprising:

(i) an open flow position where the at least one reduced outer diameter rotor projection aligns with the at least one reduced outer diameter stator projection and the at least one standard outer diameter rotor projection aligns with the at least one standard outer diameter stator projection;

(ii) an intermediate flow position where the at least one reduced outer diameter rotor projection aligns with the at least one standard outer diameter stator projection and the at least one standard outer diameter rotor projection aligns with the at least one reduced outer diameter stator projection; and (iii) a restricted flow position where the at least one reduced outer diameter rotor projection and the at least one standard outer diameter rotor projection align with the stator flow channels.

According to a second aspect, there is provided a telemetry tool comprising a pulser assembly and a fluid pressure pulse generator. The pulser assembly comprises a driveshaft and a housing surrounding at least a portion of the driveshaft. The fluid pressure pulse generator comprises: (a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body. The driveshaft is coupled to the rotor and the rotor projections are axially adjacent the stator projections, and the rotor is rotatable relative to the stator such that the rotor projections move in and out of fluid communication with the stator flow channels to create fluid pressure pulses in fluid flowing through the stator flow channels. Wherein:

(i) at least one of the rotor projections has a standard outer diameter and at least one of the rotor projections has an outer diameter which is reduced compared to the outer diameter of the at least one rotor projection with the standard outer diameter; or (ii) at least one of the stator projections has a standard outer diameter and at least one of the stator projections has an outer diameter which is reduced compared to the outer diameter of the at least one stator projection with the standard outer diameter; or (iii) at least one of the rotor projections has a standard outer diameter and at least one of the rotor projections has an outer diameter which is reduced compared to the outer diameter of the at least one rotor projection with the standard outer diameter, and at least one of the stator projections has a standard outer diameter and at least one of the stator projections has an outer diameter which is reduced compared to the outer diameter of the at least one stator projection with the standard outer diameter.

The rotor projections may have a radial profile comprising an uphole end and downhole end with two opposed side faces and a distal face extending between the uphole end and the downhole end, wherein the uphole end or the downhole end of the rotor projections comprises a rotor radial face. The radial length of the rotor radial face of the at least one rotor projection with the reduced outer diameter may be reduced compared to the radial length of the rotor radial face of the at least one rotor projection with the standard outer diameter. The stator projections may have a radial profile with an uphole end and downhole end with two opposed side faces and a distal face extending between the uphole end and the downhole end, wherein at least one of the uphole end or the downhole end of the stator projections comprises a stator radial face and the stator radial face is axially adjacent and faces the rotor radial face. The radial length of the stator radial face of the at least one stator projection with the reduced outer diameter may be reduced compared to the radial length of the stator radial face of the at least one stator projection with the standard outer diameter.

The telemetry tool may comprise two or more reduced outer diameter rotor projections and two or more standard outer diameter rotor projections, wherein the reduced outer diameter rotor projections alternate with the standard outer diameter rotor projections.

The telemetry tool may comprise two or more reduced outer diameter stator projections and two or more standard outer diameter stator projections, wherein the reduced outer diameter stator projections alternate with the standard outer diameter stator projections.

The stator body may have a bore therethrough and at least a portion of the rotor body may be received within the bore. The stator body may have a bore therethrough and an end of the stator body may be fixedly attached to the housing, and wherein the rotor may be fixedly attached to the driveshaft with the driveshaft and/or the rotor body received within the bore of the stator body such that the stator projections are positioned between the pulser assembly and the rotor projections. The rotor body may have a bore therethrough and the telemetry tool may further comprise a rotor cap comprising a cap body and a cap shaft, the cap shaft being received in the bore of the rotor body and configured to releasably couple the rotor body to the driveshaft.

The rotor projections may be downhole of the stator projections.

The telemetry tool may comprise: at least one reduced outer diameter rotor projection and at least one standard outer diameter rotor projection; and at least one reduced outer diameter stator projection and at least one standard outer diameter stator projection. The rotor may be configured to rotate between three different flow positions to generate pressure pulses, the three different flow positions comprising:

(i) an open flow position where the at least one reduced outer diameter rotor projection aligns with the at least one reduced outer diameter stator projection and the at least one standard outer diameter rotor projection aligns with the at least one standard outer diameter stator projection;

(ii) an intermediate flow position where the at least one reduced outer diameter rotor projection aligns with the at least one standard outer diameter stator projection and the at least one standard outer diameter rotor projection aligns with the at least one reduced outer diameter stator projection; and (iii) a restricted flow position where the at least one reduced outer diameter rotor projection and the at least one standard outer diameter rotor projection align with the stator flow channels.

According to another aspect, there is provided a method of generating a pattern of fluid pressure pulses comprising at least one first pressure pulse and at least one second pressure pulse. The method comprises:

a. providing the apparatus of the first aspect or the telemetry tool of the second aspect. The apparatus or telemetry tool comprising at least one reduced outer diameter rotor projection and at least one standard outer diameter rotor projection; and at least one reduced outer diameter stator projection and at least one standard outer diameter stator projection, and the rotor is configured to rotate between three different flow positions to generate pressure pulses, the three different flow positions comprising: (i) an open flow position where the at least one reduced outer diameter rotor projection aligns with the at least one reduced outer diameter stator projection and the at least one standard outer diameter rotor projection aligns with the at least one standard outer diameter stator projection; (ii) an intermediate flow position where the at least one reduced outer diameter rotor projection aligns with the at least one standard outer diameter stator projection and the at least one standard outer diameter rotor projection aligns with the at least one reduced outer diameter stator projection; and (iii) a restricted flow position where the at least one reduced outer diameter rotor projection and the at least one standard outer diameter rotor projection align with the stator flow channels;

b. positioning the rotor in a start position comprising the open flow position or the intermediate flow position;

c. generating the first pressure pulse by rotating the rotor relative to the stator from the start position in one direction to the restricted flow position, then rotating the rotor in an opposite direction back to the start position;

d. generating the second pressure pulse by rotating the rotor relative to the stator from the start position in one direction to either: the intermediate flow position if the start position is the open flow position; or the open flow position if the start position is the intermediate flow position, then rotating the rotor in an opposite direction back to the start position.

Rotation of the rotor when generating the second pressure pulse may be speeded up compared to rotation of the rotor when generating the first pressure pulse, or rotation of the rotor when generating the first pressure pulse may be slowed down compared to rotation of the rotor when generating the second pressure pulse.

The pulse shape of the second pressure pulse may comprise a leading spike caused by a pressure increase as the rotor moves through the restricted flow position followed by a pressure decrease as the rotor reaches the intermediate flow position or the open flow position. The leading spike may be used as an indicator that the second pressure pulse is being generated rather than the first pressure pulse which has no leading spike. The leading spike indicator may be used for decoding.

According to another aspect, there is provided a method of generating a pattern of fluid pressure pulses comprising at least one first pressure pulse and at least one second pressure pulse. The method comprises:

a. providing the apparatus of the first aspect or the telemetry tool of the second aspect. The apparatus or telemetry tool comprising at least one reduced outer diameter rotor projection and at least one standard outer diameter rotor projection; and at least one reduced outer diameter stator projection and at least one standard outer diameter stator projection, and the rotor is configured to rotate between three different flow positions to generate pressure pulses, the three different flow positions comprising: (i) an open flow position where the at least one reduced outer diameter rotor projection aligns with the at least one reduced outer diameter stator projection and the at least one standard outer diameter rotor projection aligns with the at least one standard outer diameter stator projection; (ii) an intermediate flow position where the at least one reduced outer diameter rotor projection aligns with the at least one standard outer diameter stator projection and the at least one standard outer diameter rotor projection aligns with the at least one reduced outer diameter stator projection; and (iii) a restricted flow position where the at least one reduced outer diameter rotor projection and the at least one standard outer diameter rotor projection align with the stator flow channels;

b. positioning the rotor in a start position comprising the restricted flow position;

c. generating the first pressure pulse by rotating the rotor relative to the stator from the start position in a first direction to the open flow position, then rotating the rotor back to the start position;

d. generating the second pressure pulse by rotating the rotor relative to the stator from the start position in a second direction opposite to the first direction to the intermediate flow position, then rotating the rotor back to the start position, wherein the first and second pressure pulses are both negative pressure pulses caused by a pressure drop and the second pressure pulse is reduced compared to the first pressure pulse.

This summary does not necessarily describe the entire scope of all aspects. Other aspects, features and advantages will be apparent to those of ordinary skill in the art upon review of the following description of specific embodiments.

DETAILED DESCRIPTION OF EMBODIMENTS

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein generally relate to a fluid pressure pulse generator of a telemetry tool that can generate pressure pulses. The fluid pressure pulse generator may be used for mud pulse ("MP") telemetry used in downhole drilling, wherein a drilling fluid or mud (herein referred to as "mud") is used to transmit telemetry pulses to surface. The fluid pressure pulse generator may alternatively be used in other methods where it is necessary to generate a fluid pressure pulse. The fluid pressure pulse generator comprises a stator and a rotor. The stator may be fixed to a pulser assembly of the telemetry tool or to a drill collar housing the telemetry tool, and the rotor is fixed to a driveshaft coupled to a motor in the pulser assembly. The motor may rotate the driveshaft and rotor relative to the stator and/or an angled blade array may be present which causes the rotor to rotate relative to the stator when mud is flowing through the fluid pressure pulse generator.

Figure 1:
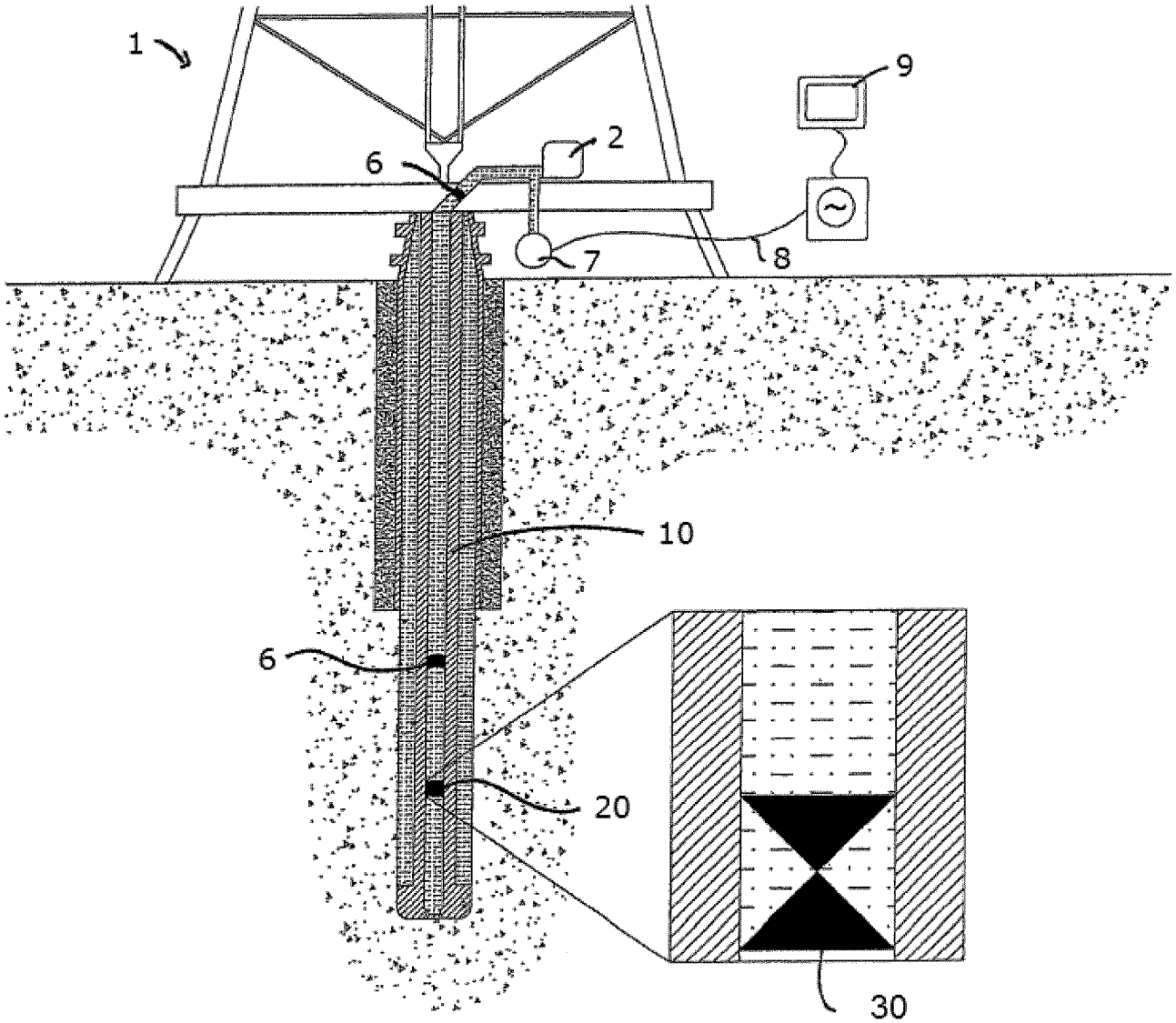
FIG. 1 is a schematic of a drill string in an oil and gas borehole comprising a MWD telemetry tool.

Referring to the drawings and specifically to FIG. 1, there is shown a schematic representation of MP telemetry operation using a measurement while drilling ("MWD") tool 20 with a fluid pressure pulse generator 30. In downhole drilling equipment 1, pump 2 pumps mud down a drill string and through the fluid pressure pulse generator 30. The fluid pressure pulse generator 30 has an open flow position in which mud flows relatively unimpeded through the fluid pressure pulse generator 30 and no pressure pulse is generated and a restricted flow position where flow of mud through the fluid pressure pulse generator 30 is restricted relative to the open flow position and a positive pressure pulse is generated (represented schematically as block 6 in mud column 10). Information acquired by downhole sensors (not shown) is transmitted in specific time divisions by pressure pulses 6 in the mud column 10. More specifically, signals from sensor modules (not shown) in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which controls timing of the fluid pressure pulse generator 30 to generate pressure pulses 6 in a controlled pattern which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency and these characteristics are used in various encoding systems to represent binary data.

Figure 2:
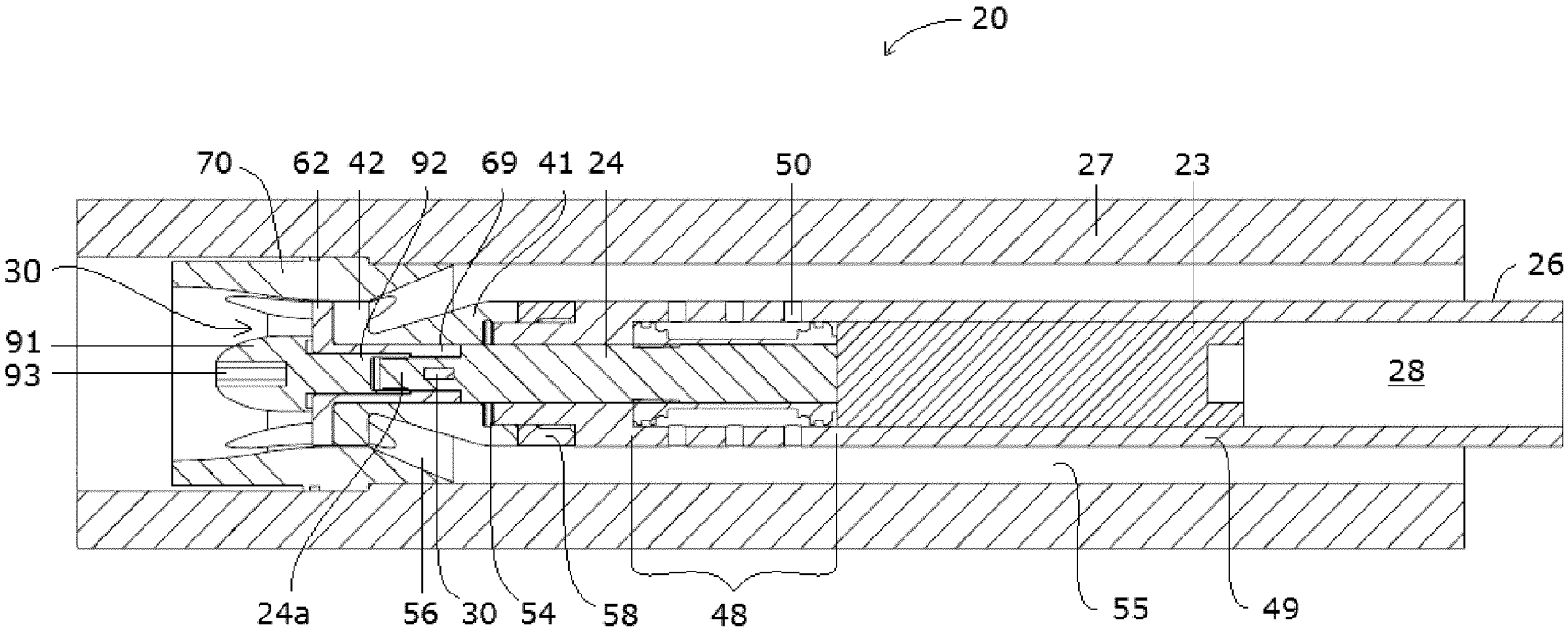
FIG. 2 is a longitudinally sectioned view of a mud pulser section of a MWD tool that includes a pulser assembly, a fluid pressure pulse generator comprising a rotor and a stator, and a flow bypass sleeve that surrounds the fluid pressure pulse generator.

Referring to FIG. 2, the mud pulser section of the MWD tool 20 is shown in more detail. The MWD tool 20 generally comprises the fluid pressure pulse generator 30 and a pulser assembly 26 which takes measurements while drilling and which drives the fluid pressure pulse generator 30. The fluid pressure pulse generator 30 and pulser assembly 26 are axially located inside a drill collar 27. A flow bypass sleeve 70 is positioned inside the drill collar 27 and surrounds the fluid pressure pulse generator 30. In the embodiments described herein, the fluid pressure pulse generator 30 is at the downhole end of the MWD tool 20, however in alternative embodiments, the fluid pressure pulse generator 30 may be positioned at the uphole end of the MWD tool 20.

The pulser assembly 26 is fixed to the drill collar 27 with an annular channel 55 therebetween, and mud flows along the annular channel 55 when the MWD tool 20 is downhole. The pulser assembly 26 comprises pulser assembly housing 49 enclosing a motor subassembly and an electronics subassembly 28 electronically coupled together but fluidly separated by a feed-through connector (not shown). The motor subassembly includes a motor and gearbox subassembly 23, a driveshaft 24 coupled to the motor and gearbox subassembly 23, and a pressure compensation device 48. The fluid pressure pulse generator 30 comprises a stator and a rotor. The stator comprises a stator body 41 with a bore therethrough and stator projections 42 radially extending around the downhole end of the stator body 41 with stator flow channels therebetween. The rotor comprises a generally cylindrical rotor body 69 with a central bore therethrough and a plurality of radially extending rotor projections 62 at the downhole end thereof.

The stator body 41 comprises a cylindrical section at the uphole end and a generally frusto-conical section at the downhole end which tapers longitudinally in the downhole direction. The cylindrical section of stator body 41 is coupled with the pulser assembly housing 49. More specifically, a jam ring 58 threaded on the stator body 41 is threaded onto the pulser assembly housing 49. Once the stator is positioned correctly, the stator is held in place and the jam ring 58 is backed off and torqued against the stator body 41 holding it in place. The external surface of the pulser assembly housing 49 is flush with the external surface of the cylindrical section of the stator body 41 for smooth flow of mud therealong. In alternative embodiments (not shown) other means of coupling the stator with the pulser assembly housing 49 may be utilized and the external surface of the stator body 41 and the pulser assembly housing 49 may not be flush.

The rotor body 69 is received in the downhole end of the bore through the stator body 41 and a downhole portion 24*a* of the driveshaft 24 is received in the uphole end of the bore through the rotor body 69. A coupling key 30 extends through the driveshaft 24 to couple the driveshaft 24 with the rotor body 69. The coupling key 30 may be any type of coupling key and may be a coupling key 30 with a zero backlash ring as described in WO 2014/071519 (incorporated herein by reference). In alternative embodiments the rotor body 69 may not have a bore therethrough which receives the driveshaft portion 24*a*, and alternative means of coupling the rotor body 69 to the driveshaft 24 may be used as would be known to a person skilled in the art.

A rotor cap comprising a cap body 91 and a cap shaft 92 is positioned at the downhole end of the fluid pressure pulse generator 30. The cap shaft 92 is received in the downhole end of the bore through the rotor body 69 and threads onto downhole driveshaft portion 24*a* to lock (torque) the rotor to the driveshaft 24. The cap body 91 includes a hexagonal shaped opening 93 dimensioned to receive a hexagonal Allen key which is used to torque the rotor to the driveshaft 24. The rotor cap therefore releasably couples the rotor to the driveshaft 24 so that the rotor can be easily removed and repaired or replaced if necessary using the Allen key. In alternative embodiments, the rotor cap may not be present.

The electronics subassembly 28 includes downhole sensors, control electronics, and other components required by the MWD tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor in a controlled pattern to generate pressure pulses 6 representing the carrier wave for transmission to surface as described above with reference to FIG. 1. In alternative embodiments, the rotor may be rotated by a blade array (not shown) in the flow path of mud flowing through the fluid pressure pulse generator. The blade array may include blades that are angled relative to the direction of flow of mud through the fluid pressure pulse generator, thereby causing the rotor to rotate when mud flows past the blades.

The motor subassembly is filled with a lubricating liquid such as hydraulic oil or silicon oil and this lubricating liquid is fluidly separated from mud flowing along annular channel 55 by annular seal 54 which surrounds and seals against the driveshaft 24. A small amount of mud may be able to enter the fluid pressure pulse generator 30 between the rotor and the stator however this entry point is downhole from annular seal 54 so the mud has to travel uphole against gravity to reach annular seal 54. The velocity of mud impinging on annular seal 54 may therefore be reduced which may result in less wear of seal 54 compared to other rotor/stator designs.

The pressure compensation device 48 comprises a flexible membrane (not shown) in fluid communication with the lubrication liquid on one side and with mud on the other side via ports 50 in the pulser assembly housing 49; this allows the pressure compensation device 48 to maintain the pressure of the lubrication liquid at about the same pressure as the mud in the annular channel 55. Without pressure compensation, the torque required to rotate the driveshaft 24 and rotor would need high current draw with excessive battery consumption resulting in increased costs. In alternative embodiments (not shown), the pressure compensation device 48 may be any pressure compensation device known in the art, such as pressure compensation devices that utilize pistons, rubber membranes, or a bellows style pressure compensation mechanism.

Mud pumped from the surface by pump 2 flows along annular channel 55 between the outer surface of the pulser assembly 26 and the inner surface of the drill collar 27. When the mud reaches the fluid pressure pulse generator 30 it flows along an annular channel 56 provided between the external surface of the stator body 41 and the internal surface of the flow bypass sleeve 70. The rotor rotates between an open flow position where mud flows freely through the fluid pressure pulse generator 30 resulting in no pressure pulse and a restricted flow position where flow of mud is restricted relative to the open flow position to generate pressure pulse 6 as described below in more detail.

In alternative embodiments (not shown), the fluid pressure pulse generator 30 may be present in the drill collar 27 without the flow bypass sleeve 70. In these alternative embodiments, the stator projections 42 may be radially extended to have an outer diameter that is greater than the outer diameter of the cylindrical section of the stator body 41 such that mud following along annular channel 55 impinges on the stator projections 42 and is directed through the stator flow channels. The stator projections 42 and rotor projections 62 may radially extend to meet the internal surface of the drill collar 27. There may be a small gap between the rotor projections 62 and the internal surface of the drill collar 27 to allow rotation of the rotor. The innovative aspects apply equally in embodiments such as these.

Figure 3:
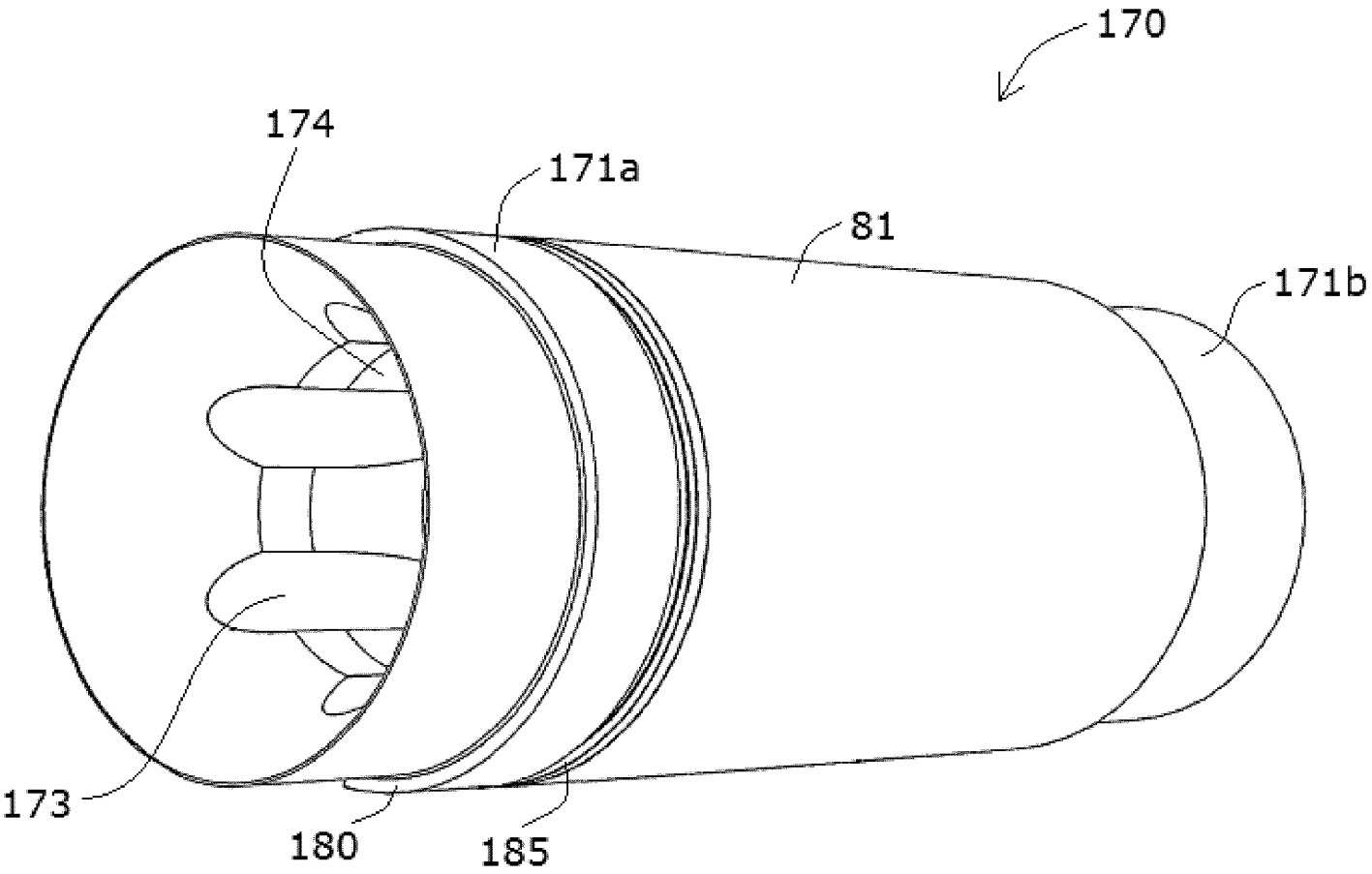
FIG. 3 is a perspective view of a first embodiment of the flow bypass sleeve.
Figure 4:
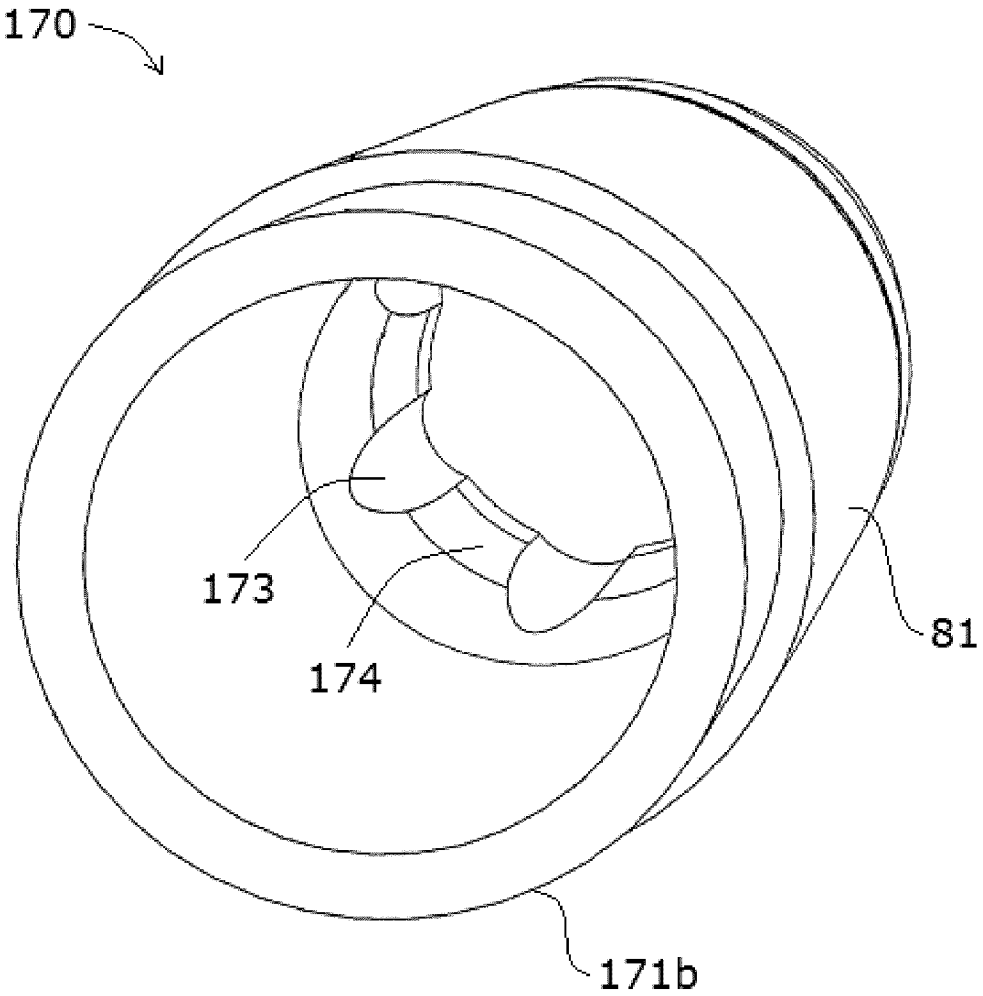
FIG. 4 is a perspective view of the downhole end of the flow bypass sleeve of the first embodiment.
Figure 5:
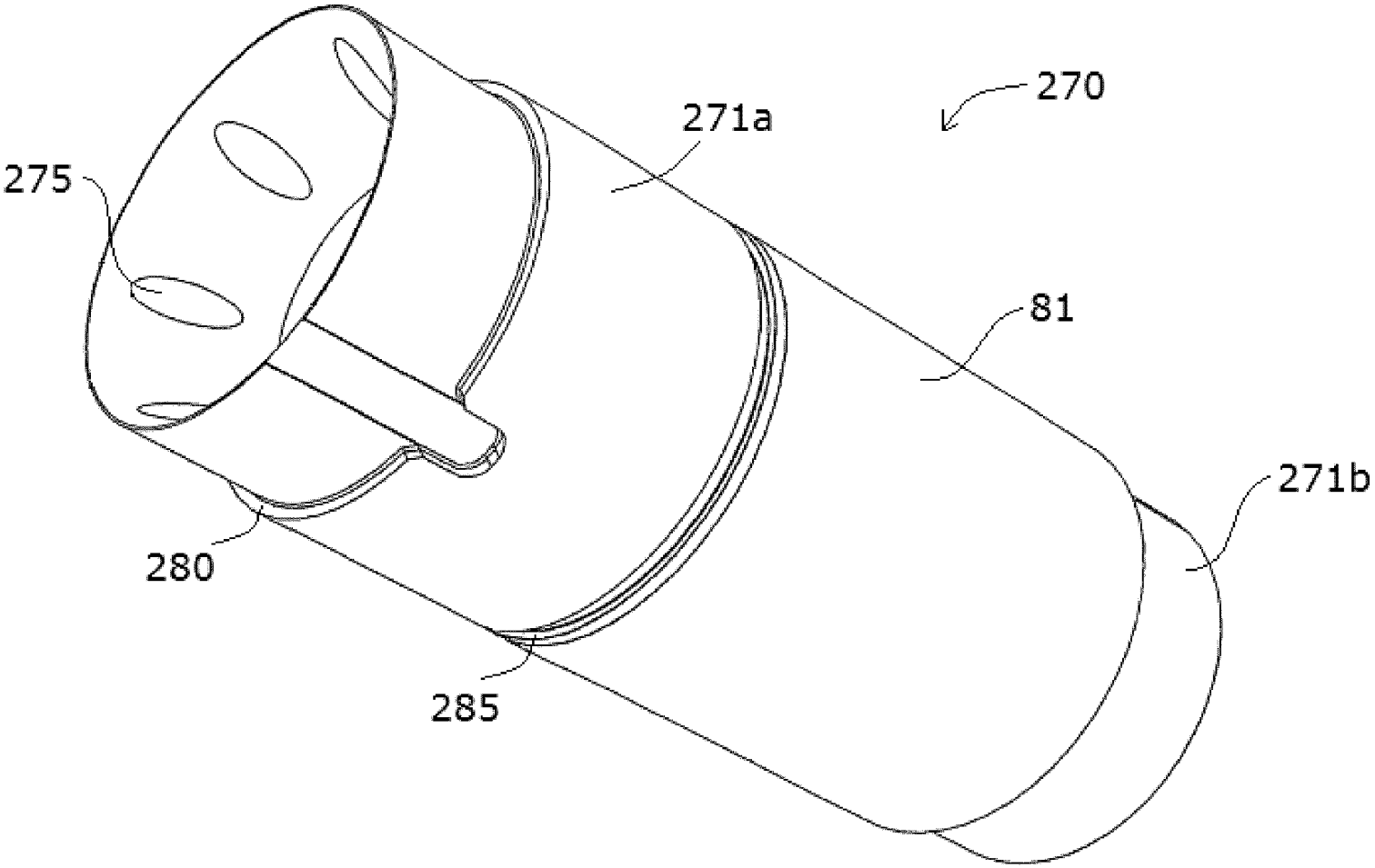
FIG. 5 is a perspective view of a second embodiment of the flow bypass sleeve.
Figure 6:
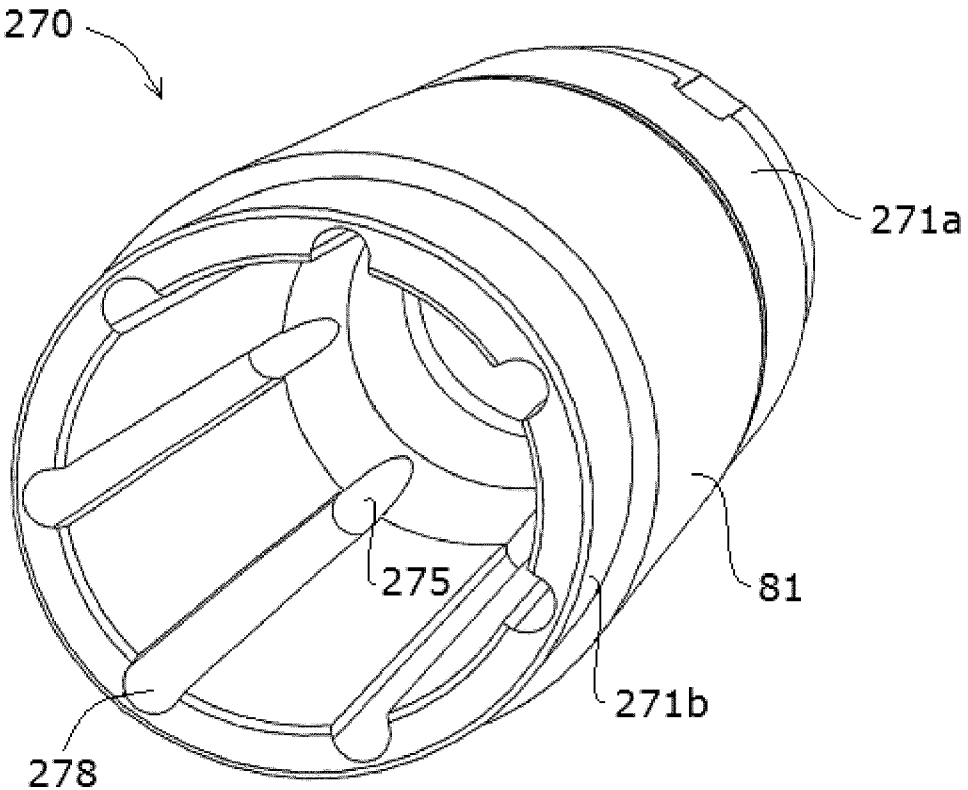
FIG. 6 is a perspective view of the downhole end of the flow bypass sleeve of the second embodiment.
Figure 7:
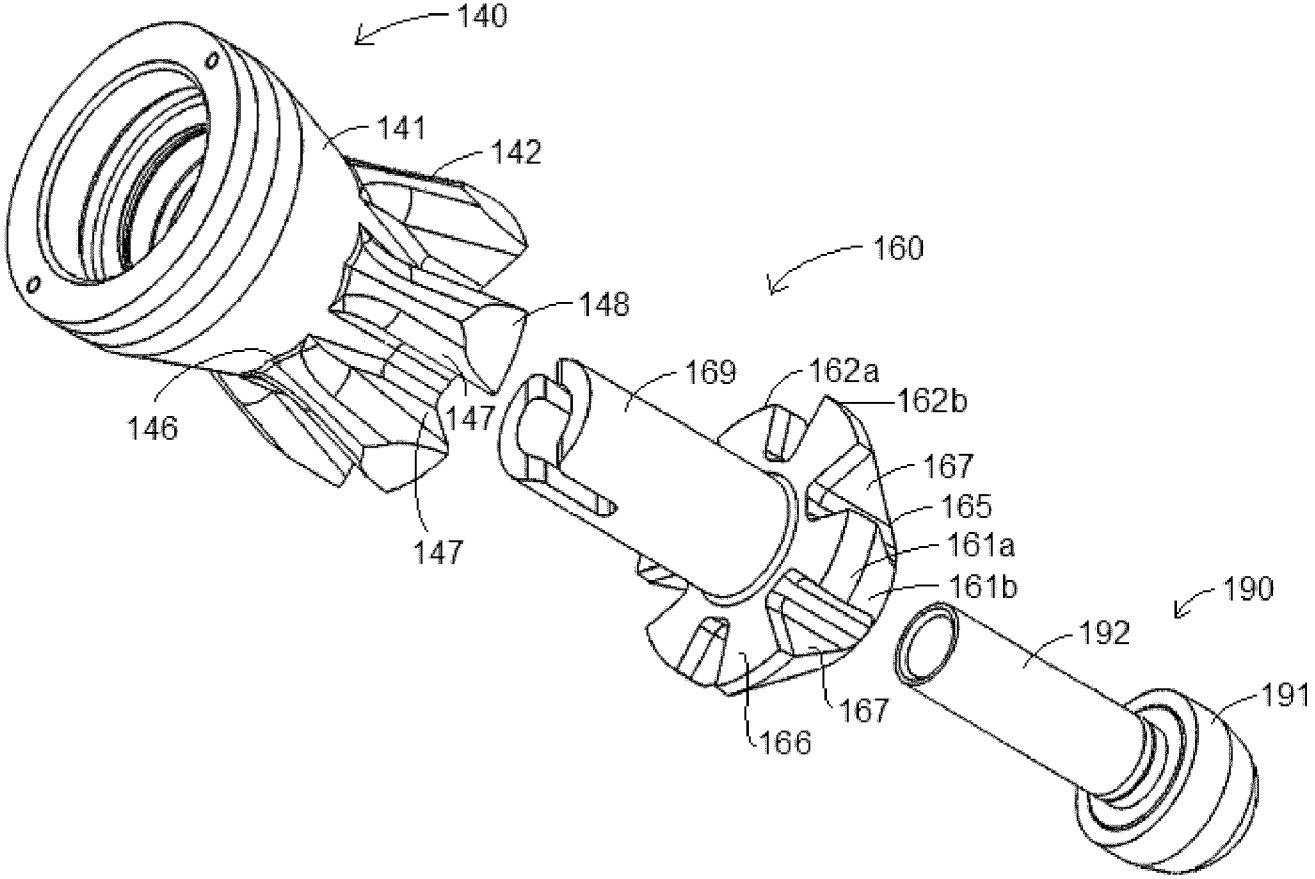
FIG. 7 is an exploded perspective view of a first embodiment of the fluid pressure pulse generator.
Figure 8:
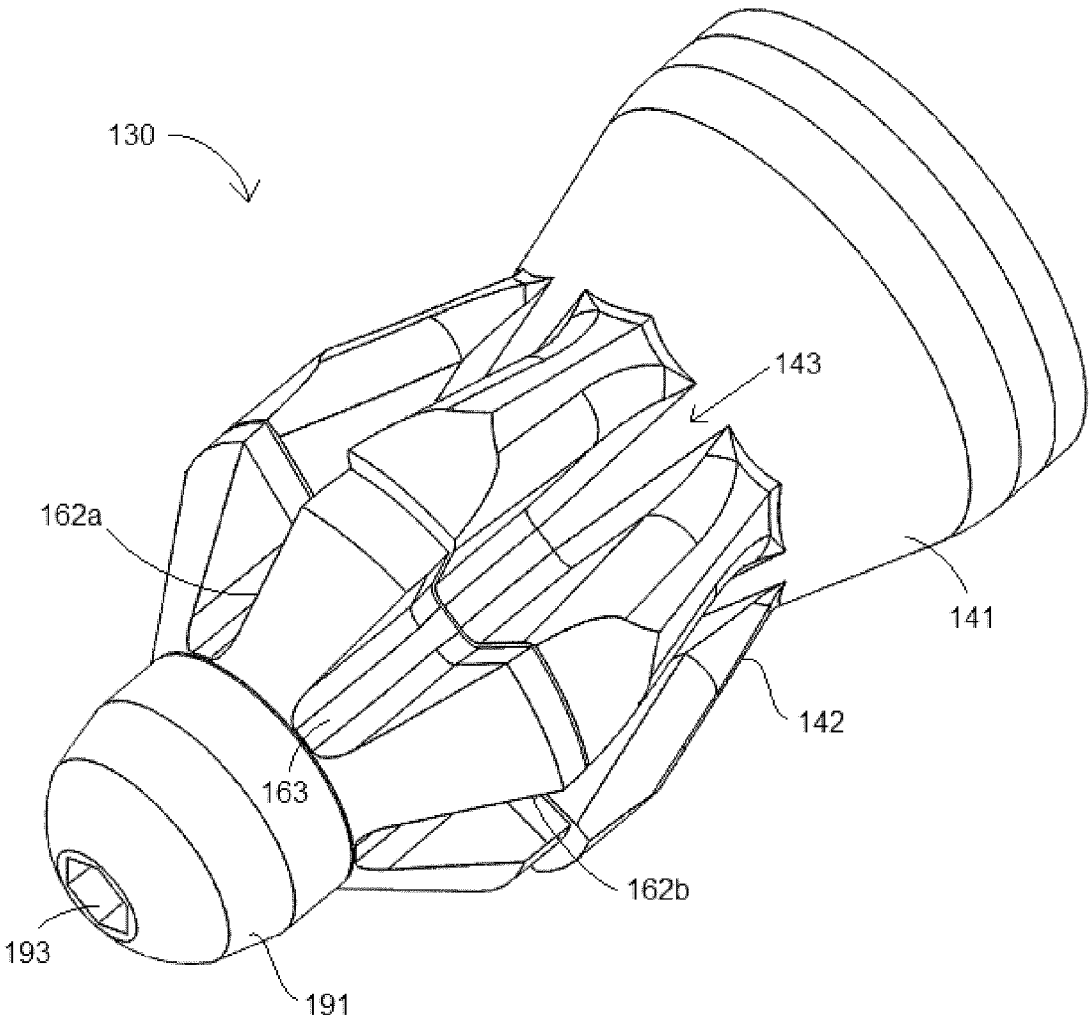
FIG. 8 is a perspective view of the fluid pressure pulse generator of the first embodiment with the rotor in an open flow position.

Referring now to FIGS. 3 and 4 there is shown a first embodiment of the flow bypass sleeve 170 comprising a generally cylindrical sleeve body with a central bore therethrough made up of an uphole body portion 171*a* and a downhole body portion 171*b*. Referring to FIGS. 5 and 6 a second embodiment of a flow bypass sleeve 270 is shown comprising a generally cylindrical sleeve body with a central bore therethrough made up of an uphole body portion 271*a* and a downhole body portion 271*b*.

During assembly of the first and second embodiments of the flow bypass sleeve 170, 270, the uphole and downhole body portions 171*a,b* and 271*a,b* are axially aligned and a lock down sleeve 81 is slid over the downhole end of the downhole body portion 171 *b*, 271*b* and moved towards the uphole body portion 171*a*, 271*a* until the uphole edge of the lock down sleeve 81 abuts an annular shoulder on the external surface of uphole body portion 171*a*, 271*a*. The assembled flow bypass sleeve 170, 270 can then be inserted into the downhole end of drill collar 27. The external surface of uphole body portion 171*a*, 271*a* includes an annular shoulder 180, 280 near the uphole end of uphole body portion 171*a*, 271*a* which abuts a downhole shoulder of a keying ring (not shown) that is fitted into the drill collar 27. A threaded ring (not shown) fixes the flow bypass sleeve 170, 270 within the drill collar 27. A groove 185, 285 on the external surface of the uphole body portion 171*a*, 271*a* receives an O-ring (not shown) and a optionally a back-up ring (not shown) such as a parbak to help seat the flow bypass sleeve 170, 270 and reduce fluid leakage between the flow bypass sleeve 170, 270 and the drill collar 27. In alternative embodiments the flow bypass sleeve 170, 270 may be assembled or fitted within the drill collar 27 using alternative fittings as would be known to a person of skill in the art.

In the first embodiment of the flow bypass sleeve 170, the internal surface of the uphole body portion 171*a* includes a plurality of longitudinal extending grooves 173. Grooves 173 are equidistantly spaced around the internal surface of the uphole body portion 171*a*. Internal walls 174 in-between each groove 173 align with the stator projections 42 of the fluid pressure pulse generator 30, and the grooves 173 align with the stator flow channels. The flow bypass sleeve 170 may be precisely located with respect to the drill collar 27 using a keying notch (not shown) to ensure correct alignment of the stator projections 42 with the internal walls 174. The rotor projections 62 rotate relative to the flow bypass sleeve 170 as the rotor moves between the open flow position and the restricted flow position as described above in more detail.

In the second embodiment of the flow bypass sleeve 270 a plurality of apertures 275 extend longitudinally through the uphole body portion 271*a*. The apertures 275 are circular and equidistantly spaced around uphole body portion 271*a*. The internal surface of the downhole body portion 271*b* includes a plurality of spaced grooves 278 which align with the apertures 275 in the assembled flow bypass sleeve 270 (shown in FIG. 6), such that mud is channeled through the apertures 275 and into grooves 278.

The external dimensions of flow bypass sleeve 170, 270 may be adapted to fit any sized drill collar 27. It is therefore possible to use a one-size-fits-all fluid pressure pulse generator 30 with multiple sized flow bypass sleeves 170, 270 with various different external circumferences that are dimensioned to fit different sized drill collars 27. Each of the multiple sized flow bypass sleeves 170, 270 may have the same internal dimensions to receive the one-size-fits-all fluid pressure pulse generator 30 but different external dimensions to fit the different sized drill collars 27.

In larger diameter drill collars 27 the volume of mud flowing through the drill collar 27 will generally be greater than the volume of mud flowing through smaller diameter drill collars 27, however the bypass channels (e.g. grooves 173 and/or apertures 275) of the flow bypass sleeve 170, 270 may be dimensioned to accommodate this greater volume of mud. The bypass channels of the different sized flow bypass sleeves 170, 270 may therefore be dimensioned such that the volume of mud flowing through the one-size-fits-all fluid pressure pulse generator 30 fitted within any sized drill collar 27 is within an optimal range for generation of pressure pulses 6 which can be detected at the surface without excessive pressure build up. It may therefore be possible to control the flow rate of mud through the fluid pressure pulse generator 30 using different flow bypass sleeves 170, 270 rather than having to fit different sized fluid pressure pulse generators 30 to the pulser assembly 26.

Referring to FIGS. 7 to 10 there is shown a first embodiment of a fluid pressure pulse generator 130 comprising a stator 140, a rotor 160 and a rotor cap 190. The stator 140 comprises a stator body 141 with a bore therethrough and stator projections 142 radially extending around the stator body 141. The stator projections 142 are generally tapered and narrower at their proximal end attached to the stator body 141 than at their distal end. The stator projections 142 have a radial profile with an uphole end 146 and a downhole face 145, with two opposed side faces 147 extending between the uphole end 146 and the downhole face 145. The stator projections 142 have a distal face 148 and each stator projection 142 tapers radially in the uphole direction, such that the radial thickness of the downhole face 145 is greater than the radial thickness of the uphole end 146 giving the stator projections 142 a wedge like shape. Mud flowing along the external surface of the stator body 141 contacts the uphole end 146 of the stator projections 142 and flows through stator flow channels 143 defined by the side faces 147 of adjacently positioned stator projections 142. The stator flow channels 143 are curved or rounded at their proximal end closest to the stator body 141. The curved stator flow channels 143, as well as the tapered stator projections 142 may provide for smooth flow of mud through the stator flow channels 143 and may reduce wear of the stator projections 142 caused by erosion. In alternative embodiments the stator projections 142 and thus the stator flow channels 143 defined therebetween may be any shape and may be dimensioned to direct flow of mud through the stator flow channels 143.

The rotor 160 comprises a generally cylindrical rotor body 169 with a central bore therethrough and a plurality of radially extending rotor projections 162*a* and 162*b* at the downhole end thereof. The rotor projections 162*a*, 162*b* are wedge shaped and equidistantly spaced around the downhole end of the rotor body 169. In the assembled fluid pressure pulse generator 130, the rotor projections 162*a*, 162*b* are axially adjacent and downhole relative to the stator projections 142. The rotor projections 162*a*, 162*b* have a radial profile with an uphole face 166 and a downhole end 165, with two opposed side faces 167 and a distal face extending between the uphole face 166 and the downhole end 165. The distal face comprises an uphole distal portion 161*a* at the uphole end of the distal face and a downhole distal portion 161*b* which tapers in the downhole direction towards the downhole end 165. The uphole distal portion 161*a* has a uniform or constant radial thickness and the radial thickness of the downhole distal portion 161*b* tapers in the downhole direction, such that the radial thickness of each rotor projection 162*a*, 162*b* tapers towards the downhole end 165 giving the rotor projections 162*a*, 162*b* their wedge like shape. The rotor projections also taper towards their proximal attachment to the rotor body 169, such that the proximal part is narrower than the distal face. In alternative embodiments, the rotor projections 162*a*, 162*b* may be any shape and need not be wedged shaped, for example the rotor projections 162*a*, 162*b* may include the uphole distal portion 161*a* but not the tapered downhole distal portion 161*b*. Rotor flow channels 163 defined by side faces 167 of adjacent rotor projections 162*a*, 162*b* are curved or rounded at the proximal end closest to the rotor body 169 for smooth flow of mud therethrough which may reduce wear of the rotor projections 162*a*, 162*b*. Positioning the stator projections 142 uphole of the rotor projections 162*a*, 162*b* may protect the rotor projections 162*a*, 162*b* from wear as they are protected from mud flow by the stator projections 142 when the rotor 160 is in the open flow position.

The uphole face 166 of each rotor projection 162*a*, 162*b* comprises a rotor radial face and the downhole face 145 of each stator projection 142 comprises a stator radial face. The rotor radial faces (uphole faces 166) and the stator radial faces (downhole faces 145) are axially adjacent and face each other in the assembled fluid pressure pulse generator 130, and the rotor radial faces (uphole faces 166) move in and out of fluid communication with the stator flow channels 143 to create fluid pressure pulses 6 in mud flowing through the stator flow channels 143. In alternative embodiments (not shown), the rotor projections 162*a*, 162*b* may be uphole of the stator projections 142 such that the rotor radial face is a downhole face of the rotor projections 162*a*, 162*b* and the stator radial face is an uphole face of the stator projections 142.

The outer diameter (OD) of rotor projections 162*a* is reduced compared to the OD of rotor projections 162*b*. The radial thickness of the uphole distal portion 161*a* of the rotor projections 162*a* with the reduced OD (hereinafter referred to as "reduced OD rotor projections 162*a*") is reduced compared to the radial thickness of the uphole distal portion 161*a* of the rotor projections 162*b* with the standard or normal OD (hereinafter referred to as "standard OD rotor projections 162*b*"). The radial length of the uphole face 166 of the reduced OD rotor projections 162*a* is also reduced compared to the radial length of the uphole face 166 of the standard OD rotor projections 162*b*. In the embodiment shown in FIGS. 7 to 10, the reduced OD rotor projections 162*a* and the standard OD rotor projections 162*b* are alternating, however in alternative embodiments the arrangement of the reduced OD rotor projections 162*a* and standard OD rotor projections 162*b* may have a different pattern. For example, there may be two adjacent reduced OD rotor projections 162*a* positioned between each standard OD rotor projections 162*b* or a different arrangement provided there is at least one standard OD rotor projections 162*b* and at least one reduced OD projection 162*a*.

The rotor cap 190 comprises a cap body 191 and cap shaft 192. The cap body 191 is downhole of the rotor projections 162*a*, 162*b* in the assembled fluid pressure pulse generator 130 and the cap shaft 192 is received within the bore of the rotor body 169 as described above with reference to FIG. 2. The rounded cone shaped cap body 191 may provide a streamlined flow path for mud and may reduce wear of the rotor projections 162*a*, 162*b* caused by recirculation of mud. The rounded cap body 191 may also reduce torque required to rotate the rotor 160 by reducing turbulence downhole of the rotor 160. The cap body 191 includes a hexagonal shaped opening 193 dimensioned to receive a hexagonal Allen key which is used to releasably torque the rotor to the driveshaft 24 as described above with reference to FIG. 2. In alternative embodiments, the rotor cap 190 may not be present.

During downhole operation of the MWD tool 20, a controller (not shown) in the electronics subassembly 28 sends motor control signals to a motor in the motor and gearbox subassembly 23 to rotate the driveshaft 24 and rotor 160 in a controlled pattern to generate pressure pulses 6. Alternatively or additionally, the rotor 160 may be coupled to an angled blade array (not shown) such as the angled blade arrays disclosed in WO 2015/196282 (incorporated herein by reference) and mud flowing through the angled blade array may rotate the rotor 160. The rotor projections 162*a*, 162*b* align with the stator projections 142 when the rotor 160 is in the open flow position shown in FIG. 8 and mud flows relatively unrestricted through the stator flow channels 143 and rotor flow channels 163 with zero pressure. A pressure pulse 6 is generated when the rotor 160 rotates to the restricted flow position shown in FIGS. 9 and 10 where the rotor projections 162*a*, 162*b* align with the stator flow channels 143 and the volume of mud flowing through the fluid pressure pulse generator 130 is reduced compared to the volume of mud flowing through the fluid pressure pulse generator 130 when the rotor 160 is in the open flow position.

Figure 9:
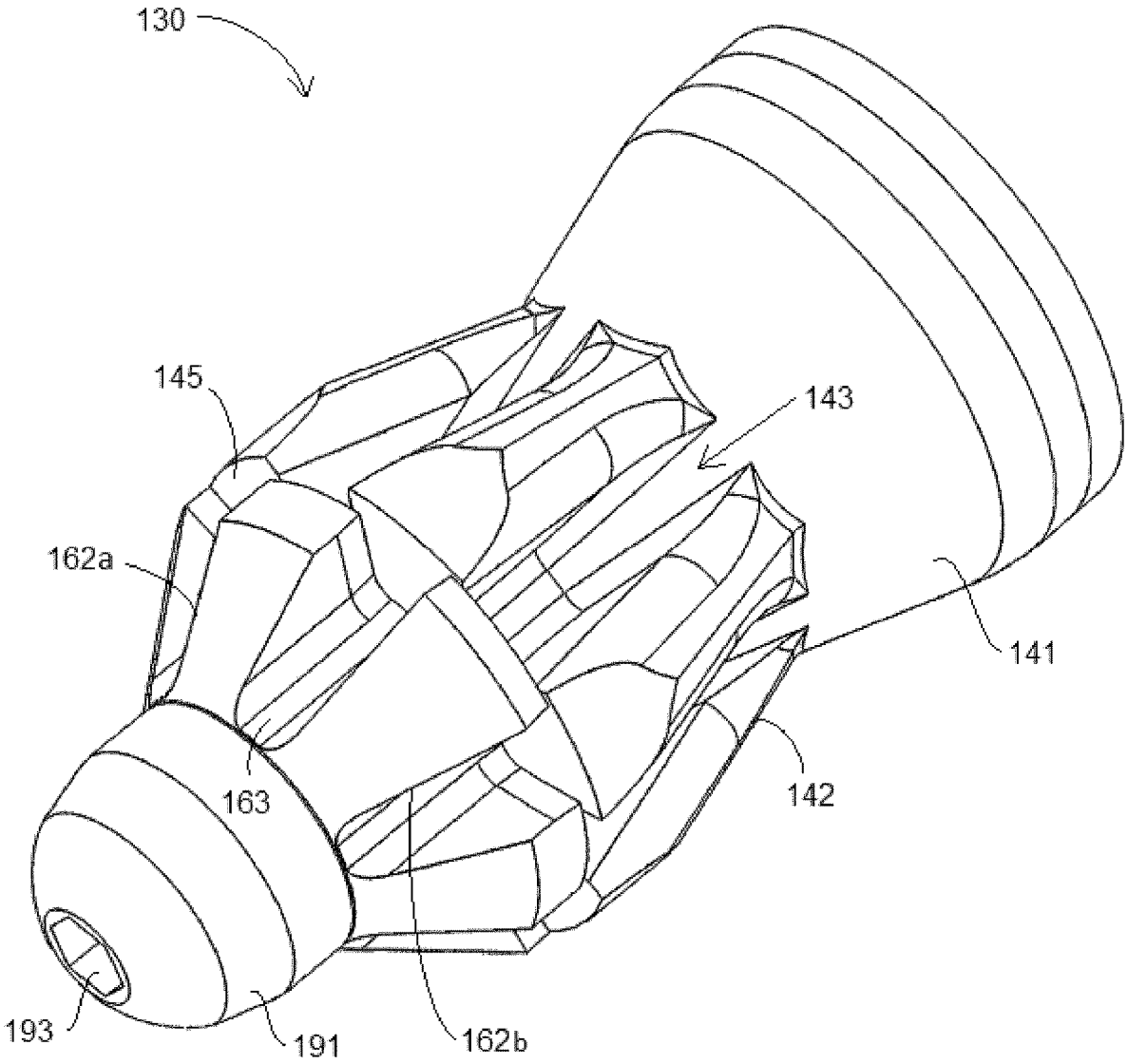
FIG. 9 is a perspective view of the fluid pressure pulse generator of the first embodiment with the rotor in a restricted flow position.
Figure 10B:
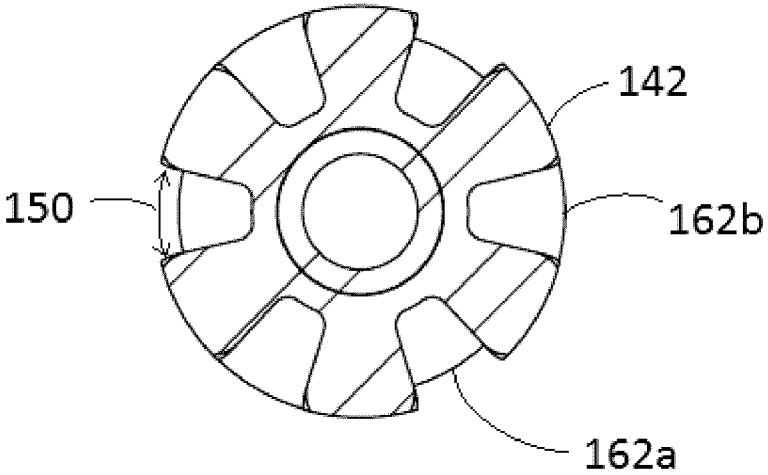
FIG. 10A is a side view of the fluid pressure pulse generator of the first embodiment with the rotor in the restricted flow position and FIG. 10B is a plan view of a cross section through line A-A of the fluid pressure pulse generator of FIG. 10A.
Figure 10A:
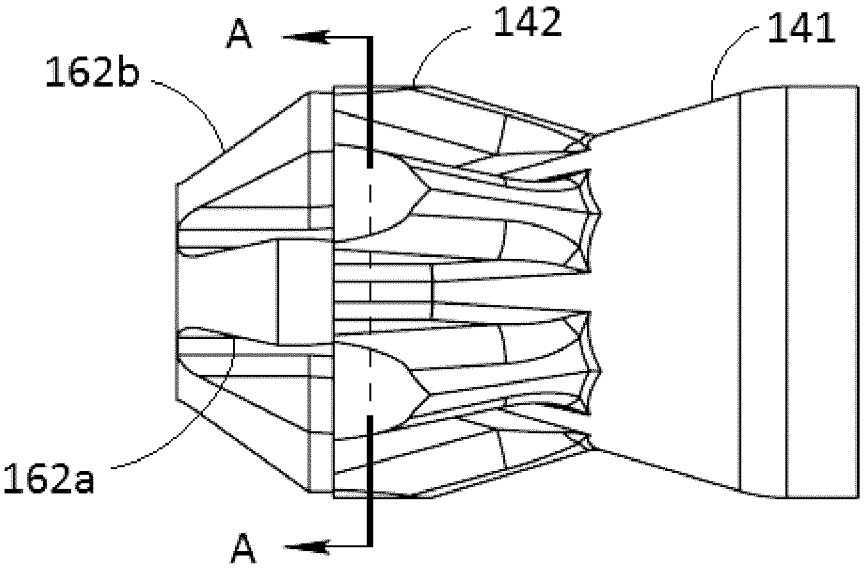

In the embodiment of the fluid pressure pulse generator 130 shown in FIGS. 9 and 10, the downhole face 145 of each of the stator projections 142 overlies a portion of the uphole face 166 of one of the reduced OD rotor projections 162*a* and an adjacent standard OD rotor projection 162*b*, when the fluid pressure pulse generator 130 is in the restricted flow position; however, in alternative embodiments, there may be a gap between the downhole face 145 of the stator projections and the uphole face 166 of the rotor projections 162*a*, 162*b* when the fluid pressure pulse generator 130 is in the restricted flow position allowing some mud to flow from the stator flow channels 143 to the rotor flow channels 163. The rotor projections 162*a*, 162*b* rotate in and out of fluid communication with the stator flow channels 143 in a controlled pattern to generate pressure pulses 6 representing the carrier wave for transmission to surface.

In alternative embodiments (not shown), the rotor projections 162*a*, 162*b* may be axially adjacent and uphole of the stator projections 142 and/or the fluid pressure pulse generator 130 may be positioned at the uphole end of the pulser assembly 26. In further alternative embodiments (not shown), the fluid pressure pulse generator 130 may be a dual height pressure pulse generator as described in WO 2015/196289 (incorporated herein by reference) where the rotor 160 rotates in one direction from the open flow (start) position to a partial restricted flow position and in the opposite direction to a full restricted flow position to respectively generate a partial and full pressure pulse, with the partial pressure pulse being reduced compared to the full pressure pulse. The innovative aspects apply equally in embodiments such as these.

As shown in FIG. 10B, when the rotor 160 is in the restricted flow position, the reduced OD rotor projections 162*a* provide bypass channels 150 allowing mud and debris to flow between the reduced OD rotor projections 162*a* and the internal surface of the flow bypass sleeve 70 or the internal surface of the drill collar 27 if the flow bypass sleeve 70 is not present. This may reduce pressure build-up and blockage caused by debris and may reduce the likelihood of packing off solids by allowing a larger flow path for particles and debris in the mud when the rotor 160 is in the restricted flow position. It may therefore be possible to use the fluid pressure pulse generator 130 in higher mud flow conditions than a fluid pressure pulse generator where all the rotor projections have a standard OD. The reduced OD rotor projections 162*a* may be dimensioned for optimal mud flow through the bypass channels 150 depending on mud flow conditions downhole and the OD of the reduced OD rotor projections 162*a* on the rotor 160 may vary and they may not all have the same OD as shown in the rotor 160 of the first embodiment of the fluid pressure pulse generator 130. Furthermore, the number of reduced OD rotor projections 162*a* compared to standard OD rotor projections 162*b* may vary depending on mud flow conditions downhole.

The rotor 160 can be easily removed and replaced by a different rotor 160 by removing the rotor cap 190 using an Allen key as discussed above in more detail. A set of rotors 160 may be provided as a kit with each rotor 160 having different dimensioned reduced OD rotor projections 162*a* and/or a different number of reduced OD rotor projections

162*a* to allow for different mud flow conditions downhole. Provision of two or more standard OD rotor projections 162*b* on the rotor 160 may beneficially ensure concentric mounting of the rotor 160 within the flow bypass sleeve 70 or the drill collar 27. The standard OD rotor projections 162*b* may therefore act as alignment projections allowing correct alignment of the rotor 160 within the flow bypass sleeve 70 or the drill collar 27. The standard OD rotor projections 162*b* may also protect the rotor 160 during installation as the rotor is concentrically mounted within the flow bypass sleeve 70 or drill collar 27 and there is less movement of the rotor 160 compared to a rotor where all of the rotor projections have a reduced OD compared to the stator projections 142.

Figure 11:
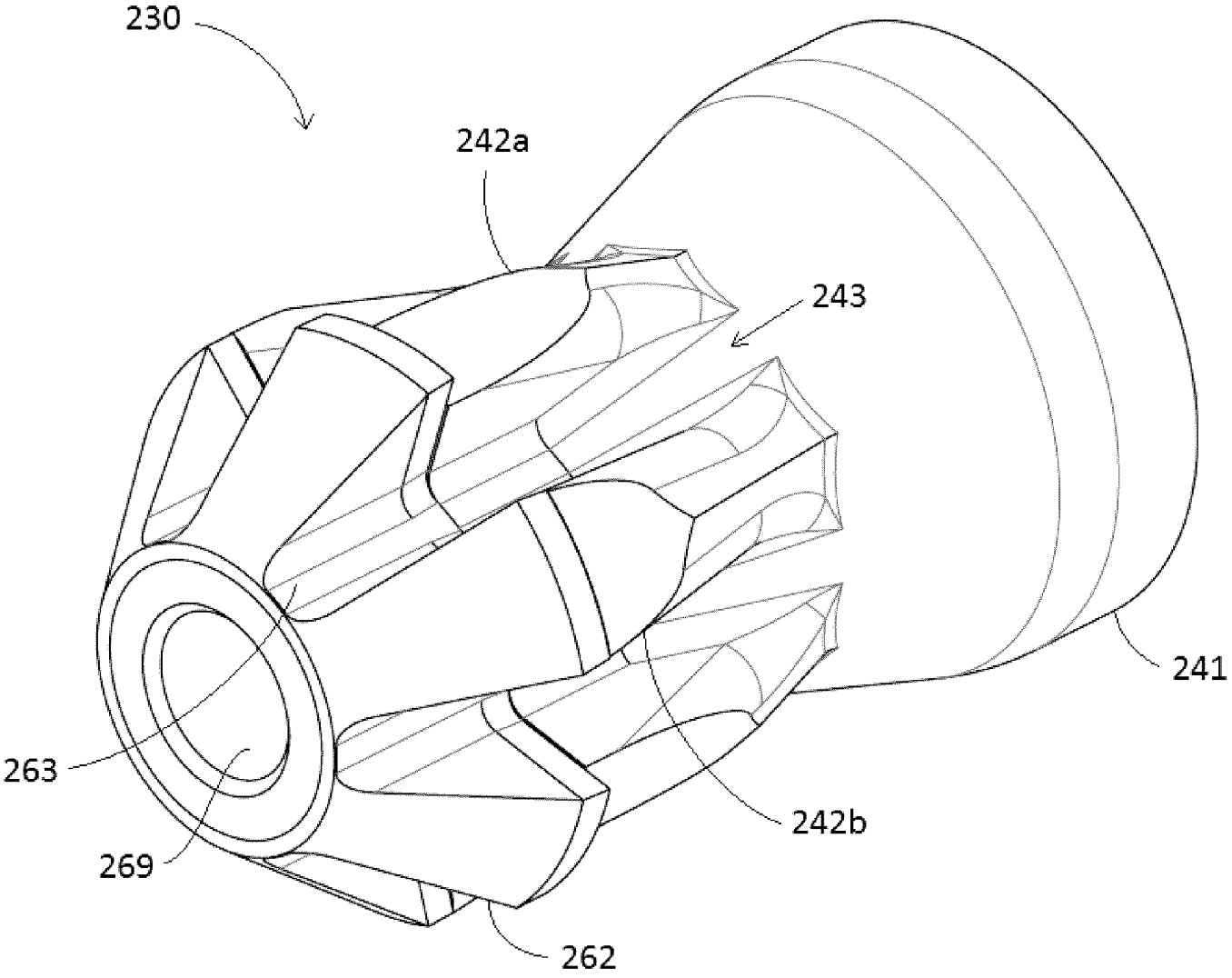
FIG. 11 is a perspective view of a second embodiment of the fluid pressure pulse generator with the rotor in an open flow position.
Figure 12:
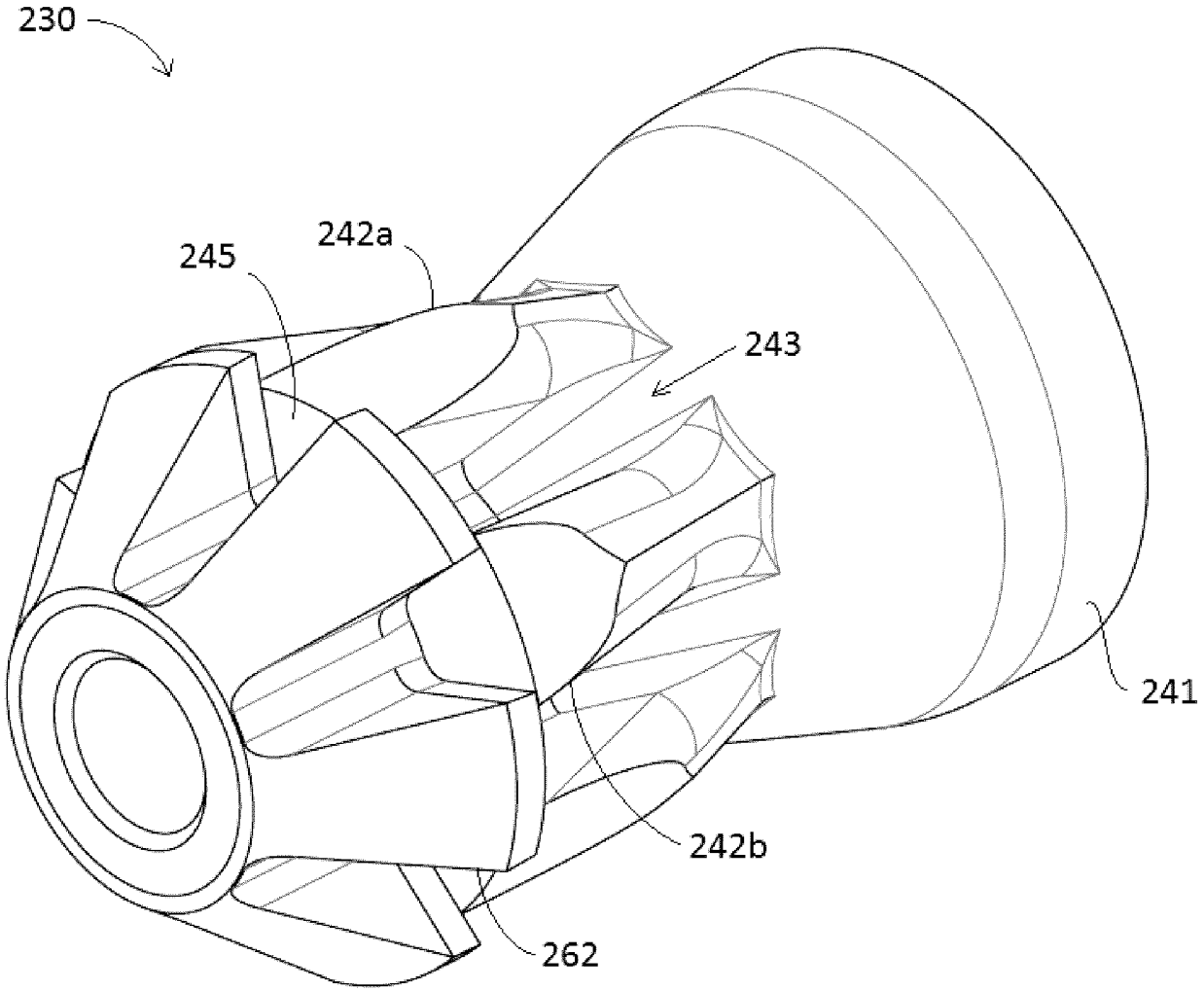
FIG. 12 is a perspective view of the fluid pressure pulse generator of the second embodiment with the rotor in a restricted flow position.
Figure 13B:
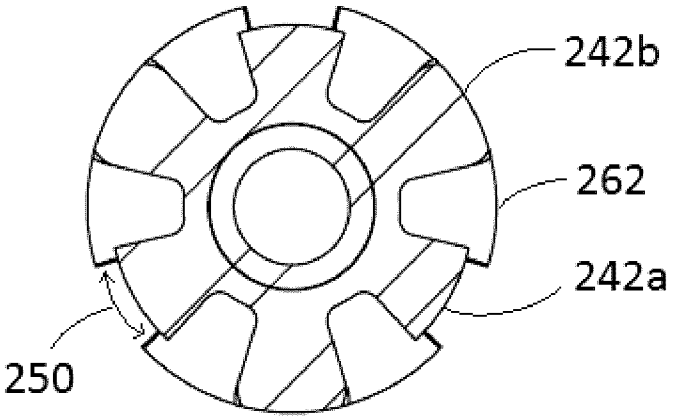
FIG. 13A is a side view of the fluid pressure pulse generator of the second embodiment with the rotor in the restricted flow position and FIG. 13B is a plan view of a cross section through line A-A of the fluid pressure pulse generator of FIG. 13A.
Figure 13A:
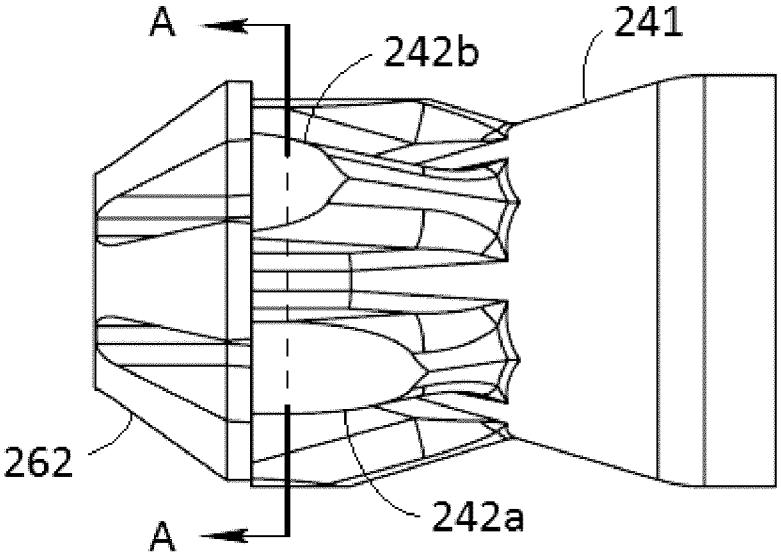

Referring now to FIGS. 11 to 13, there is shown a second embodiment of a fluid pressure pulse generator 230 comprising a rotor and a stator. The rotor comprises a rotor body 269 with a bore therethrough, and wedge like rotor projections 262 equidistantly spaced around the downhole end of a rotor body 269 with rotor flow channels 263 therebetween. The rotor body 269 may be coupled to the driveshaft 24 using a rotor cap as herein before described with reference to FIGS. 2 and 7-10. The stator comprises a stator body 241 with a bore therethrough, and alternating reduced OD stator projections 242*a* and standard OD stator projections 242*b* equidistantly spaced around the downhole end of the stator body 241 with stator flow channels 243 therebetween. The radial length of the downhole face 245 of the reduced OD stator projections 242*a* is reduced compared to the radial length of the downhole face 245 of the standard OD stator projections 242*b*. The radial thickness of the reduced OD stator projections 242*a* is therefore less than the radial thickness of the standard OD stator projections 242*b*. In alternative embodiments the arrangement of reduced OD stator projections 242*a* and standard OD stator projections 242*b* may not be alternating and may have a different pattern.

During downhole operation of the MWD tool 20, the rotor rotates relative to the stator between an open flow position shown in FIG. 11 and a restricted flow position shown in FIGS. 12 and 13. Rotor projections 262 align with the stator projections 242*a*, 242*b* when the rotor is in the open flow position and mud flows relatively unrestricted through the stator flow channels 243 and rotor flow channels 263 with zero pressure. A pressure pulse 6 is generated when the rotor rotates to the restricted flow position shown in FIGS. 12 and 13 where the rotor projections 262 align with the stator flow channels 243 and the volume of mud flowing through the fluid pressure pulse generator 230 is reduced compared to the volume of mud flowing through the fluid pressure pulse generator 230 when the rotor is in the open flow position. The rotor projections 262 rotate in and out of fluid communication with the stator flow channels 243 in a controlled pattern to generate pressure pulses 6 representing the carrier wave for transmission to surface.

In alternative embodiments (not shown), the rotor projections 262 may be axially adjacent and uphole of the stator projections 242*a*, 242*b* and/or the fluid pressure pulse generator 230 may be positioned at the uphole end of the pulser assembly 26. In further alternative embodiments (not shown), the fluid pressure pulse generator 230 may be a dual height pressure pulse generator as described in WO 2015/196289 (incorporated herein by reference) where the rotor rotates in one direction from the open flow (start) position to a partial restricted flow position and in the opposite direction to a full restricted flow position to respectively generate a partial and full pressure pulse, with the partial pressure pulse being reduced compared to the full pressure pulse. The innovative aspects apply equally in embodiments such as these.

As show in FIG. 13B, when the rotor is in the restricted flow position, the reduced OD stator projections 242*a* provide a bypass channel 250 allowing mud and debris to flow between the reduced OD stator projections 242*a* and the internal surface of the flow bypass sleeve 70 or the internal surface of the drill collar 27 if the flow bypass sleeve 70 is not present. This may reduce pressure build-up and blockage caused by debris and may reduce the likelihood of packing off solids by allowing a larger flow path for particles and debris in the mud when the rotor is in the restricted flow position. The fluid pressure pulse generator 230 may also be used in higher mud flow conditions than a fluid pressure pulse generator where all the stator projections have a standard OD. The reduced OD stator projections 242*a* may be dimensioned for optimal mud flow through the bypass channels 250 depending on mud flow conditions downhole and the OD of the reduced stator projections 242*a* on the stator may vary and they may not all have the same OD as shown in the stator of the second embodiment of the fluid pressure pulse generator 230. Furthermore, the number of reduced OD stator projections 242*a* compared to standard OD stator projections 242*b* may be varied depending on mud flow conditions downhole.

Provision of two or more standard OD stator projections 242*b* may ensure concentric mounting of the fluid pressure pulse generator 230 within the flow bypass sleeve 70 or the drill collar 27. The standard OD stator projections 242*b* may therefore act as alignment projections allowing correct alignment of the stator within the flow bypass sleeve 70 or the drill collar 27. The standard OD stator projections 242*b* may also protect the rotor and stator during installation and removal of the fluid pressure pulse generator as the stator is concentrically mounted within the flow bypass sleeve 70 or drill collar 27 and there is less movement of the stator compared to a stator where all of the stator projections have a reduced OD compared to the rotor projections 262. The standard OD stator projections 242*b* may also help prevent the rotor getting caught and damaged on the edges flow bypass sleeve 70 or drill collar 27 as the MWD tool 20 is pulled out.

Figure 14:
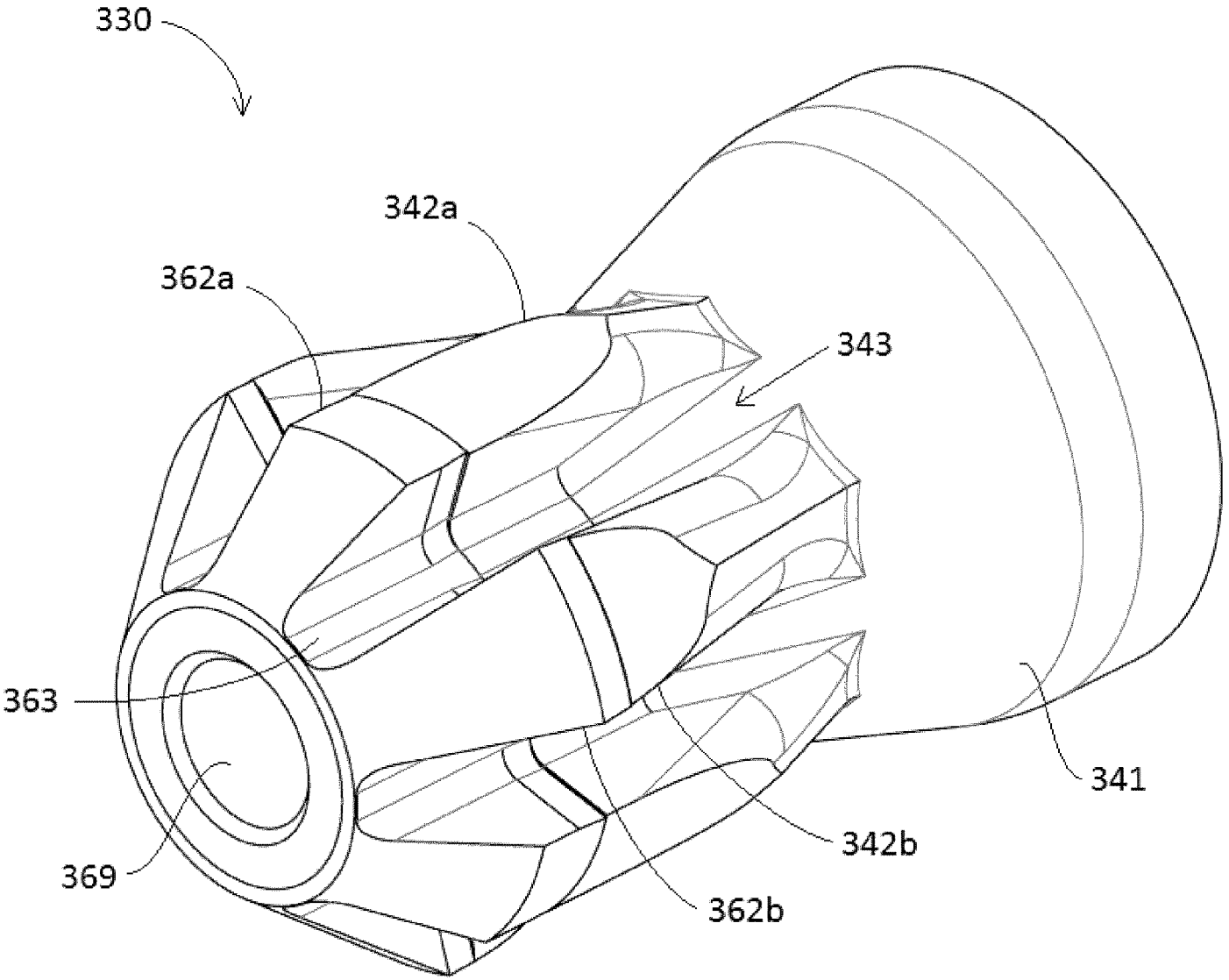
FIG. 14 is a perspective view of a third embodiment of the fluid pressure pulse generator with the rotor in an open flow position.
Figure 15:
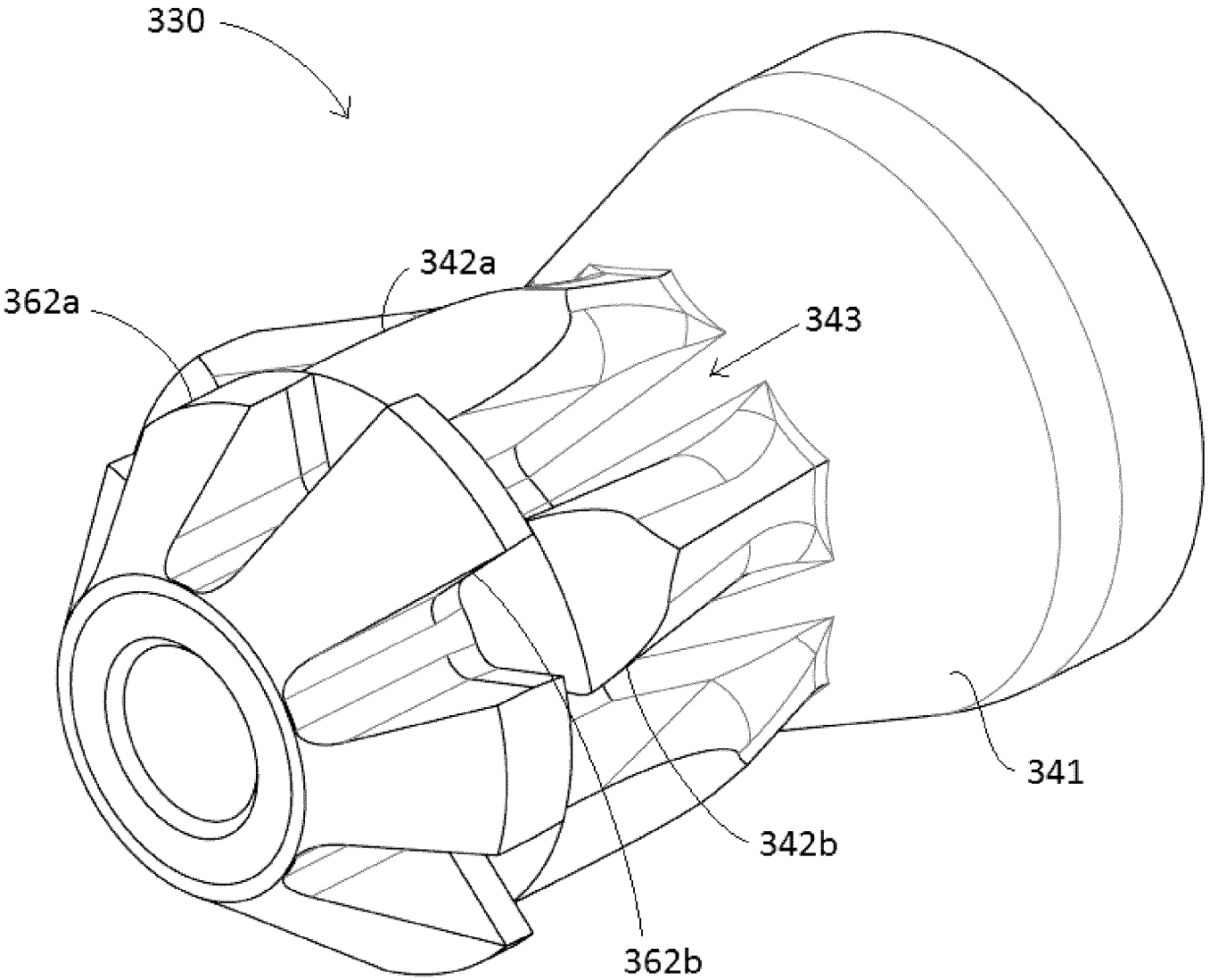
FIG. 15 is a perspective view of the fluid pressure pulse generator of the third embodiment with the rotor in a restricted flow position.
Figure 16B:
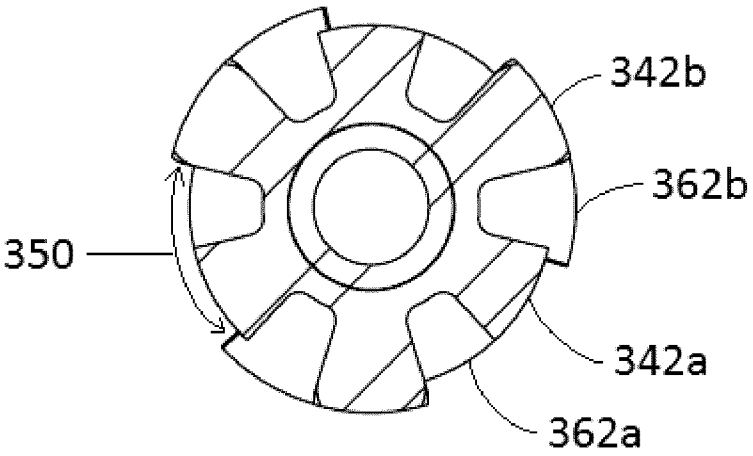
FIG. 16A is a side view of the fluid pressure pulse generator of the third embodiment with the rotor in the restricted flow position and FIG. 16B is a plan view of a cross section through line A-A of the fluid pressure pulse generator of FIG. 16A.
Figure 16A:
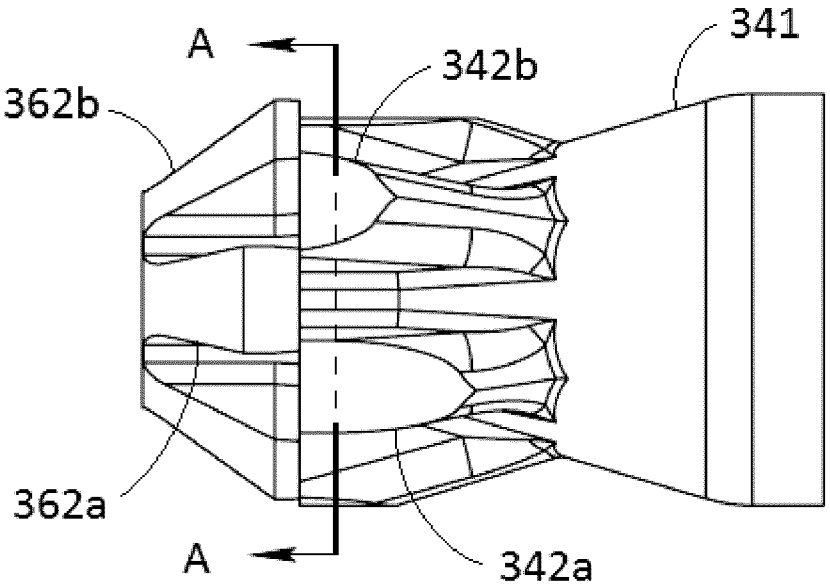

Referring now to FIGS. 14 to 16, there is shown a third embodiment of a fluid pressure pulse generator 330 comprising a rotor and a stator. The rotor of the third embodiment of the fluid pressure pulse generator 330 is similar to the rotor 160 of the first embodiment of the fluid pressure pulse generator 130, and comprises a rotor body 369 with a bore therethrough and alternating reduced OD rotor projections 362*a* and standard OD rotor projections 362*b* equidistantly spaced around the downhole end of the rotor body 369 with rotor flow channels 363 therebetween. The stator of the third embodiment of the fluid pressure pulse generator 330 is similar to the stator of the second embodiment of the fluid pressure pulse generator 230, and comprises a stator body 341 with a bore therethrough, and alternating reduced OD stator projections 342*a* and standard OD stator projections 342*b* equidistantly spaced around the downhole end of the stator body 341 with stator flow channels 343 therebetween. In alternative embodiments the arrangement of the reduced OD stator projections 342*a*/standard OD stator projections 342*b* and the reduced OD rotor projections 362*a*/standard OD rotor projections 362*b* may not be alternating and may have a different pattern. In further alternative embodiments (not shown), the rotor projections 362*a*, 362*b* may be axially adjacent and uphole of the stator projections 342*a*, 342*b* and/or the fluid pressure pulse generator 330 may be positioned at the uphole end of the pulser assembly 26.

In one embodiment during downhole operation of the MWD tool 20, the rotor rotates relative to the stator between an open flow position shown in FIG. 14 and a restricted flow position shown in FIGS. 15 and 16. Reduced OD rotor projections 362*a* align with reduced OD stator projections 342*a* and standard OD rotor projections 362*b* align with standard OD stator projections 342*b* when the rotor is in the open flow position and mud flows relatively unrestricted through the stator flow channels 343 and rotor flow channels 363. A bypass channel is also provided between the internal surface of the flow bypass sleeve 70 or drill collar 27 and the aligned reduced OD rotor and stator projections 362*a*, 342*a* when the rotor is in the open flow position. A pressure pulse 6 is generated when the rotor rotates to the restricted flow position where the rotor projections 362*a*, 362*b* align with the stator flow channels 343 and the volume of mud flowing through the fluid pressure pulse generator 330 is reduced compared to the volume of mud flowing through the fluid pressure pulse generator 330 when the rotor is in the open flow position. The rotor projections 362*a*, 362*b* rotate in and out of fluid communication with the stator flow channels 343 in a controlled pattern to generate pressure pulses 6 representing the carrier wave for transmission to surface.

As shown in FIG. 16B, when the rotor is in the restricted flow position, the reduced OD stator and rotor projections 342*a*, 362*a* provide bypass channels 350 allowing mud and debris to flow between the reduced OD stator and rotor projections 342*a*, 362*a* and the internal surface of the flow bypass sleeve 70 or the internal surface of the drill collar 27 if the flow bypass sleeve 70 is not present. The bypass channels 350 may reduce pressure build-up and blockage caused by debris and may reduce the likelihood of packing off solids by allowing a larger flow path for particles and debris in the mud when the rotor is in the restricted flow position. The bypass channels 350 have a larger flow area than bypass channels 150 and 250 of the first and second embodiment of the fluid pressure pulse generator 130, 230 respectively; therefore it may be possible to use the third embodiment of the fluid pressure pulse generator 330 in higher mud flow conditions than the first and second embodiment of the fluid pressure pulse generator 130, 230. The reduced OD rotor and stator projections 362*a*, 342*a* may be dimensioned to allow more or less mud to flow through the bypass channels 350 depending on mud flow conditions downhole. Furthermore, the number of reduced OD stator projections 342*a* compared to standard OD stator projections 342*b* and the number of reduced OD rotor projections 362*a* compared to standard OD rotor projections 362*b* may be varied depending on mud flow conditions downhole.

In an alternative embodiment, the rotor of the fluid pressure pulse generator 330 may rotate from an intermediate flow position (not shown) to the restricted flow position shown in FIGS. 15 and 16 to generate intermediate pressure pulses which are of reduced height compared to the full pressure pulses generated when the rotor rotates between the open flow position shown in FIG. 14 and the restricted flow position shown in FIGS. 15 and 16. In the intermediate flow position the reduced OD rotor projections 362*a* align with the standard OD stator projections 342*b* and the standard OD rotor projections 362*b* align with the reduced OD stator projections 342*a* so that mud flows from the stator flow channels 343 to the rotor flow channels 363, however there is no bypass channel provided between the reduced OD stator and rotor projections 342*a*, 362*a* and the internal surface of the flow bypass sleeve 70 or drill collar 27 as there is in the open flow position. The pressure differential between the intermediate and restricted flow positions is therefore smaller than the pressure differential between the open flow position and the restricted flow position and a reduced (intermediate) height pressure pulse is generated compared to the full height pressure pulse.

The third embodiment of the fluid pressure pulse generator 330 also may be used as a dual height pressure pulse generator as described in WO 2015/196289 (incorporated herein by reference) capable of generating a pattern of different pressure pulses comprising pressure pulses with two different pulse heights. As discussed above full height pressure pulses can be generated by rotating the rotor between the open flow position shown in FIG. 14 and the restricted flow position shown in FIGS. 15 and 16 and intermediate height pressure pulses can be generated by rotating the rotor between the intermediate flow position (where the reduced OD rotor projections 362*a* align with the standard OD stator projections 342*b* and the standard OD rotor projections 362*b* align with the reduced OD stator projections 342*a*) and the restricted flow position.

The third embodiment of the fluid pressure pulse generator 330 may be used to generate a pattern of different pressure pulses using the intermediate flow position (where the reduced OD rotor projections 362*a* align with the standard OD stator projections 342*b* and the standard OD rotor projections 362*b* align with the reduced OD stator projections 342*a*) as the start or home position for the rotor. A first pressure pulse may be generated by rotating the rotor 30 degrees in one direction (either clockwise or counter-clockwise) from the intermediate flow position to the restricted flow position (shown in FIGS. 15 and 16) and back 30 degrees in the opposite direction to the intermediate flow position. A second pressure pulse may be generated by rotating the rotor 60 degrees in one direction (either clockwise or counter clockwise) from the intermediate flow position through the restricted flow position to the open flow position (shown in FIG. 14) and back 60 degrees in the opposite direction to the intermediate flow position. The first pressure pulse is a positive pressure pulse caused by a pressure rise as the rotor moves from the intermediate flow position to the restricted flow position. The second pressure pulse is a negative pressure pulse cause by a pressure drop as the rotor moves from the intermediate flow position to the open flow position. The pulse shape of the second pressure pulse generally has a leading spike (pressure rise) as the rotor moves through the restricted flow position followed by a pressure drop as the rotor reaches the open flow position. The leading spike may be beneficial for decoding as it may act as an indicator that the pressure pulse is the second pressure pulse rather than the first pressure pulse which has no leading spike.

The third embodiment of the fluid pressure pulse generator 330 may also be used to generate a pattern of pressure pulses using the open flow position (shown in FIG. 14) as the start or home position for the rotor. A first pressure pulse may be generated by rotating the rotor 30 degrees in one direction (either clockwise or counter-clockwise) from the open flow position to the restricted flow position (shown in FIGS. 15 and 16) and back 30 degrees in the opposite direction to the open flow position. A second pressure pulse may be generated by rotating the rotor 60 degrees in one direction (either clockwise or counter clockwise) from the open flow position through the restricted flow position to the intermediate flow position (where the reduced OD rotor projections 362*a* align with the standard OD stator projections 342*b* and the standard OD rotor projections 362*b* align with the reduced OD stator projections 342*a*) and back 60 degrees in the opposite direction to the open flow position. The first and second pressure pulses are both positive pressure pulses caused by a rise in pressure, however the second pressure pulse is reduced compared to the first pressure pulse. The pulse shape of the second pressure pulse generally has a leading spike (pressure rise) as the rotor moves through the restricted flow position followed by a pressure decrease as the rotor reaches the intermediate flow position. The leading spike may be beneficial for decoding as it may act as an indicator that the pressure pulse is the second pressure pulse rather than the first pressure pulse which has no leading spike.

In generating the pattern of pressure pulses discussed above, where the rotor start (home) position is either the intermediate flow position or the open flow position, the first pressure pulse is generated by a 30 degree rotation in both directions and the second pressure pulse is generated by a 60 degree rotation in both directions. In order to provide consistent timing for generating both the first and second pressure pulses, rotation of the rotor for the 30 degree rotation may be slowed down to match the timing of the 60 degree rotation, or rotation of the rotor for the 60 degree rotation may be speeded up to match the timing of the 30 degree rotation.

The third embodiment of the fluid pressure pulse generator 330 may also be used to generate a pattern of pressure pulses using the restricted flow position (shown in FIGS. 15 and 16) as the start or home position for the rotor. A first pressure pulse may be generated by rotating the rotor 30 degrees in a first direction from the restricted flow position to the open flow position (shown in FIG. 14) and back 30 degrees to the restricted flow position. A second pressure pulse may be generated by rotating the rotor 30 degrees in a second direction opposite to the first direction from the restricted flow position to the intermediate flow position (where the reduced OD rotor projections 362*a* align with the standard OD stator projections 342*b* and the standard OD rotor projections 362*b* align with the reduced OD stator projections 342*a*) and back 30 degrees to the restricted flow position. The first and second pressure pulses are both negative pressure pulses caused by a drop in pressure, however the second pressure pulse is reduced compared to the first pressure pulse. This method of generating a pattern of dual height negative pressure pulses may be beneficial for data encoding as the fluid pressure pulse generator 330 may be able to drop pressure quicker than it rises and pressure pulses generated by a pressure drop (i.e. a negative pressure pulse) may therefore have sharper edges than pressure pulses generated by a pressure rise (i.e. positive pressure pulses). The sharper edged negative pressure pulses generated using this method may result in quicker data encoding and may allow for a higher data rate than when positive pressure pulses are generated.

In alternative embodiments, the number and spacing of the rotor projections 362*a*, 362*b* and the stator projections 342*a*, 342*b* may be different and the amount of rotation of the rotor required to generate the first and second pressure pulses will vary accordingly.

While particular embodiments have been described in the foregoing, it is to be understood that other embodiments are possible and are intended to be included herein. It will be clear to any person skilled in the art that modification of and adjustments to the foregoing embodiments, not shown, are possible.

The invention claimed is:

1. A fluid pressure pulse generator apparatus for a telemetry tool, comprising:

(a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body, wherein the rotor projections are axially adjacent the stator projections and the rotor is rotatable relative to the stator such that the rotor projections move in and out of fluid communication with the stator flow channels to create fluid pressure pulses in fluid flowing through the stator flow channels, and wherein:

(i) at least one of the rotor projections has a standard outer diameter and at least one of the rotor projections has an outer diameter which is reduced compared to the outer diameter of the at least one of the rotor projections with the standard outer diameter; or (ii) at least one of the stator projections has a standard outer diameter and at least one of the stator projections has an outer diameter which is reduced compared to the outer diameter of the at least one of the stator projections with the standard outer diameter; or (iii) at least one of the rotor projections has a standard outer diameter and at least one of the rotor projections has an outer diameter which is reduced compared to the outer diameter of the at least one of the rotor projections with the standard outer diameter, and at least one of the stator projections has a standard outer diameter and at least one of the stator projections has an outer diameter which is reduced compared to the outer diameter of the at least one of the stator projections with the standard outer diameter.

2. The apparatus of claim 1, wherein the rotor projections have a radial profile comprising an uphole end and downhole end with two opposed side faces and a distal face extending between the uphole end and the downhole end, wherein the uphole end or the downhole end of the rotor projections comprises a rotor radial face.

3. The apparatus of claim 2, wherein a radial length of the rotor radial face of the at least one of the rotor projections with the reduced outer diameter is reduced compared to the radial length of the rotor radial face of the at least one of the rotor projections with the standard outer diameter.

4. The apparatus of claim 2, wherein the stator projections have a radial profile with an uphole end and downhole end with two opposed side faces and a distal face extending between the uphole end and the downhole end of the stator projections, wherein at least one of the uphole end or the downhole end of the stator projections comprises a stator radial face and the stator radial face is axially adjacent and faces the rotor radial face.

5. The apparatus of claim 4, wherein a radial length of the stator radial face of the at least one of the stator projections with the reduced outer diameter is reduced compared to the radial length of the stator radial face of the at least one of the stator projections with the standard outer diameter.

6. The apparatus of claim 1 comprising two or more reduced outer diameter rotor projections and two or more standard outer diameter rotor projections, wherein the two or more reduced outer diameter rotor projections alternate with the two or more standard outer diameter rotor projections.

7. The apparatus of claim 1 comprising two or more reduced outer diameter stator projections and two or more standard outer diameter stator projections, wherein the two or more reduced outer diameter stator projections alternate with the two or more standard outer diameter stator projections.

8. The apparatus of claim 1, wherein the stator body has a bore therethrough and at least a portion of the rotor body is received within the bore of the stator body.

9. The apparatus of claim 8, wherein the rotor body has a bore therethrough and the apparatus further comprises a rotor cap comprising a cap body and a cap shaft, the cap shaft being received in the bore of the rotor body and configured to releasably couple the rotor body to a driveshaft of the telemetry tool.

10. The apparatus of claim 1, wherein the rotor projections are downhole of the stator projections.

11. A fluid pressure pulse generator apparatus for a telemetry tool, comprising:

(a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body, wherein the rotor projections are axially adjacent the stator projections and the rotor is rotatable relative to the stator such that the rotor projections move in and out of fluid communication with the stator flow channels to create fluid pressure pulses in fluid flowing through the stator flow channels, and wherein: at least one of the rotor projections has a standard outer diameter and at least one of the rotor projections has an outer diameter which is reduced compared to the outer diameter of the at least one of the rotor projections with the standard outer diameter, and at least one of the stator projections has a standard outer diameter and at least one of the stator projections has an outer diameter which is reduced compared to the outer diameter of the at least one of the stator projections with the standard outer diameter, wherein the rotor is configured to rotate between three different flow positions to generate the fluid pressure pulses, the three different flow positions comprising:

(i) an open flow position where the at least one of the rotor projections with the reduced outer diameter aligns with the at least one of the stator projections with the reduced outer diameter and the at least one of the rotor projections with the standard outer diameter aligns with the at least one of the stator projections with the standard outer diameter;

(ii) an intermediate flow position where the at least one of the rotor projections with the reduced outer diameter aligns with the at least one of the stator projections with the standard outer diameter and the at least one of the rotor projections with the standard outer diameter aligns with the at least one of the stator projections with the reduced outer diameter; and (iii) a restricted flow position where the at least one of the rotor projections with the reduced outer diameter and the at least one of the rotor projections with the standard outer diameter align with the stator flow channels.

12. A telemetry tool comprising:

a pulser assembly comprising a driveshaft and a housing surrounding at least a portion of the driveshaft; and a fluid pressure pulse generator comprising:

(a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body, wherein the driveshaft is coupled to the rotor and the rotor projections are axially adjacent the stator projections, and the rotor is rotatable relative to the stator such that the rotor projections move in and out of fluid communication with the stator flow channels to create fluid pressure pulses in fluid flowing through the stator flow channels, and wherein:

(i) at least one of the rotor projections has a standard outer diameter and at least one of the rotor projections has an outer diameter which is reduced compared to the outer diameter of the at least one of the rotor projections with the standard outer diameter; or (ii) at least one of the stator projections has a standard outer diameter and at least one of the stator projections has an outer diameter which is reduced compared to the outer diameter of the at least one of the stator projections with the standard outer diameter; or (iii) at least one of the rotor projections has a standard outer diameter and at least one of the rotor projections has an outer diameter which is reduced compared to the outer diameter of the at least one of the rotor projections with the standard outer diameter, and at least one of the stator projections has a standard outer diameter and at least one of the stator projections has an outer diameter which is reduced compared to the outer diameter of the at least one of the stator projections with the standard outer diameter.

13. The telemetry tool of claim 12, wherein the rotor projections have a radial profile comprising an uphole end and downhole end with two opposed side faces and a distal face extending between the uphole end and the downhole end of the rotor projections, wherein the uphole end or the downhole end of the rotor projections comprises a rotor radial face.

14. The telemetry tool of claim 13, wherein a radial length of the rotor radial face of the at least one of the rotor projections with the reduced outer diameter is reduced compared to the radial length of the rotor radial face of the at least one of the rotor projections with the standard outer diameter.

15. The telemetry tool of claim 13, wherein the stator projections have a radial profile with an uphole end and downhole end with two opposed side faces and a distal face extending between the uphole end and the downhole end of the stator projections, wherein at least one of the uphole end or the downhole end of the stator projections comprises a stator radial face and the stator radial face is axially adjacent and faces the rotor radial face.

16. The telemetry tool of claim 15, wherein a radial length of the stator radial face of the at least one of the stator projections with the reduced outer diameter is reduced compared to the radial length of the stator radial face of the at least one of the stator projections with the standard outer diameter.

17. The telemetry tool of claim 12 comprising two or more reduced outer diameter rotor projections and two or more standard outer diameter rotor projections, wherein the two or more reduced outer diameter rotor projections alternate with the two or more standard outer diameter rotor projections.

18. The telemetry tool of claim 12, comprising two or more reduced outer diameter stator projections and two or more standard outer diameter stator projections, wherein the two or more reduced outer diameter stator projections alternate with the two or more standard outer diameter stator projections.

19. The telemetry tool of claim 12, wherein the stator body has a bore therethrough and at least a portion of the rotor body is received within the bore of the stator body.

20. The telemetry tool of claim 19, wherein the rotor body has a bore therethrough and the telemetry tool further comprises a rotor cap comprising a cap body and a cap shaft, the cap shaft being received in the bore of the rotor body and configured to releasably couple the rotor body to the driveshaft.

21. The telemetry tool of claim 12, wherein the stator body has a bore therethrough and an end of the stator body is fixedly attached to the housing, and wherein the rotor is fixedly attached to the driveshaft with the driveshaft and/or the rotor body received within the bore of the stator body such that the stator projections are positioned between the pulser assembly and the rotor projections.

22. The telemetry tool of claim 12, wherein the rotor projections are downhole of the stator projections.

23. A telemetry tool comprising:

a pulser assembly comprising a driveshaft and a housing surrounding at least a portion of the driveshaft; and a fluid pressure pulse generator comprising:

(a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body, wherein the driveshaft is coupled to the rotor and the rotor projections are axially adjacent the stator projections, and the rotor is rotatable relative to the stator such that the rotor projections move in and out of fluid communication with the stator flow channels to create fluid pressure pulses in fluid flowing through the stator flow channels, and wherein: at least one of the rotor projections has a standard outer diameter and at least one of the rotor projections has an outer diameter which is reduced compared to the outer diameter of the at least one of the rotor projections with the standard outer diameter, and at least one of the stator projections has a standard outer diameter and at least one of the stator projections has an outer diameter which is reduced compared to the outer diameter of the at least one of the stator projections with the standard outer diameter, wherein the rotor is configured to rotate between three different flow positions to generate the fluid pressure pulses, the three different flow positions comprising:

(i) an open flow position where the at least one of the rotor projections with the reduced outer diameter rotor projection aligns with the at least one of the stator projections with the reduced outer diameter and the at least one of the rotor projections with the standard outer diameter aligns with the at least one of the stator projections with the standard outer diameter;

(ii) an intermediate flow position where the at least one of the rotor projections with the reduced outer diameter aligns with the at least one of the stator projections with the standard outer diameter and the at least one of the rotor projections with the standard outer diameter with the at least one of the stator projections with the reduced outer diameter; and (iii) a restricted flow position where the at least one of the rotor projections with the reduced outer diameter and the at least one of the rotor projections with the standard outer diameter align with the stator flow channels.

24. A method of generating a pattern of fluid pressure pulses comprising at least one first pressure pulse and at least one second pressure pulse, the method comprising:

a. providing a fluid pressure pulse generator apparatus for a telemetry tool, comprising:

(a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body, wherein the rotor projections are axially adjacent the stator projections and the rotor is rotatable relative to the stator such that the rotor projections move in and out of fluid communication with the stator flow channels to create the fluid pressure pulses in fluid flowing through the stator flow channels, and wherein: at least one of the rotor projections has a standard outer diameter and at least one of the rotor projections has an outer diameter which is reduced compared to the outer diameter of the at least one of the rotor projections with the standard outer diameter, and at least one of the stator projections has a standard outer diameter and at least one of the stator projections has an outer diameter which is reduced compared to the outer diameter of the at least one of the stator projections with the standard outer diameter, wherein the rotor is configured to rotate between three different flow positions to generate the fluid pressure pulses, the three different flow positions comprising:

(i) an open flow position where the at least one of the rotor projections with the reduced outer diameter aligns with the at least one of the stator projections with the reduced outer diameter and the at least one of the rotor projections with the standard outer diameter aligns with the at least one of the stator projections with the standard outer diameter;

(ii) an intermediate flow position where the at least one of the rotor projections with the reduced outer diameter aligns with the at least one of the stator projections with the standard outer diameter and the at least one of the rotor projections with the standard outer diameter aligns with the at least one of the stator projections with the reduced outer diameter; and (iii) a restricted flow position where the at least one of the rotor projections with the reduced outer diameter and the at least one of the rotor projections with the standard outer diameter align with the stator flow channels;

b. positioning the rotor in a start position comprising the open flow position or the intermediate flow position;

c. generating the at least one first pressure pulse by rotating the rotor relative to the stator from the start position in one direction to the restricted flow position, then rotating the rotor in an opposite direction back to the start position; and d. generating the at least one second pressure pulse by rotating the rotor relative to the stator from the start position in one direction to either: the intermediate flow position if the start position is the open flow position; or the open flow position if the start position is the intermediate flow position, then rotating the rotor in an opposite direction back to the start position.

25. The method of claim 24, wherein the rotation of the rotor when generating the at least one second pressure pulse is speeded up compared to the rotation of the rotor when generating the at least one first pressure pulse, or the rotation of the rotor when generating the at least one first pressure pulse is slowed down compared to the rotation of the rotor when generating the at least one second pressure pulse.

26. The method of claim 24, wherein a pulse shape of the at least one second pressure pulse comprises a leading spike caused by a pressure increase as the rotor moves through the restricted flow position followed by a pressure decrease as the rotor reaches the intermediate flow position or the open flow position.

27. The method of claim 26, wherein the leading spike is used as an indicator that the at least one second pressure pulse is being generated rather than the at least one first pressure pulse which has no leading spike.

28. The method of claim 27, wherein the leading spike used as the indicator is used for decoding.

29. A method of generating a pattern of fluid pressure pulses comprising at least one first pressure pulse and at least one second pressure pulse, the method comprising:

a. providing a fluid pressure pulse generator apparatus for a telemetry tool, comprising:

(a) a stator comprising a stator body and a plurality of radially extending stator projections spaced around the stator body, wherein the spaced stator projections define stator flow channels extending therebetween; and (b) a rotor comprising a rotor body and a plurality of radially extending rotor projections spaced around the rotor body, wherein the rotor projections are axially adjacent the stator projections and the rotor is rotatable relative to the stator such that the rotor projections move in and out of fluid communication with the stator flow channels to create the fluid pressure pulses in fluid flowing through the stator flow channels, and wherein: at least one of the rotor projections has a standard outer diameter and at least one of the rotor projections has an outer diameter which is reduced compared to the outer diameter of the at least one of the rotor projections with the standard outer diameter, and at least one of the stator projections has a standard outer diameter and at least one of the stator projections has an outer diameter which is reduced compared to the outer diameter of the at least one of the stator projections with the standard outer diameter, wherein the rotor is configured to rotate between three different flow positions to generate the fluid pressure pulses, the three different flow positions comprising:

(i) an open flow position where the at least one of the rotor projections with the reduced outer diameter aligns with the at least one of the stator projections with the reduced outer diameter and the at least one of the rotor projections with the standard outer diameter aligns with the at least one of the stator projections with the standard outer diameter;

(ii) an intermediate flow position where the at least one of the rotor projections with the reduced outer diameter aligns with the at least one of the stator projections with the standard outer diameter and the at least one of the rotor projections with the standard outer diameter aligns with the at least one of the stator projections with the reduced outer diameter; and (iii) a restricted flow position where the at least one of the rotor projections with the reduced outer diameter and the at least one of the rotor projections with the standard outer diameter align with the stator flow channels;

b. positioning the rotor in a start position comprising the restricted flow position;

c. generating the at least one first pressure pulse by rotating the rotor relative to the stator from the start position in a first direction to the open flow position, then rotating the rotor back to the start position; and d. generating the at least one second pressure pulse by rotating the rotor relative to the stator from the start position in a second direction opposite to the first direction to the intermediate flow position, then rotating the rotor back to the start position, wherein the at least one first pressure pulse and the at least one second pressure pulse are both negative pressure pulses caused by a pressure drop and the at least one second pressure pulse is reduced compared to the at least one first pressure pulse.

* * * * *